US011203829B2

(12) United States Patent
Lee et al.

(10) Patent No.: US 11,203,829 B2
(45) Date of Patent: Dec. 21, 2021

(54) APPARATUS FOR TREATING LAUNDRY AND METHOD FOR OPERATING THE SAME

(71) Applicant: LG ELECTRONICS INC., Seoul (KR)

(72) Inventors: Sang Hyun Lee, Seoul (KR); Bon Kwon Koo, Seoul (KR); Hyun Ji Park, Seoul (KR); Seung Chul Cha, Suwon-si (KR)

(73) Assignee: LG ELECTRONICS INC., Seoul (KR)

( * ) Notice: Subject to any disclaimer, the term of this patent is extended or adjusted under 35 U.S.C. 154(b) by 112 days.

(21) Appl. No.: 16/561,963

(22) Filed: Sep. 5, 2019

(65) Prior Publication Data

US 2019/0390392 A1 Dec. 26, 2019

(30) Foreign Application Priority Data

Jul. 19, 2019 (KR) ..... 10-2019-0087856

(51) Int. Cl.
*D06F 39/00* (2020.01)
*D06F 33/32* (2020.01)
(Continued)

(52) U.S. Cl.
CPC ..... *D06F 33/32* (2020.02); *D06F 34/18* (2020.02); *D06F 34/05* (2020.02); *D06F 34/28* (2020.02);
(Continued)

(58) Field of Classification Search
None
See application file for complete search history.

(56) References Cited

U.S. PATENT DOCUMENTS 5,259,217 A * 11/1993 Civanelli ..... D06F 34/18 68/12.04
2013/0239337 A1* 9/2013 Kim ..... D06F 34/18 8/137
(Continued)

FOREIGN PATENT DOCUMENTS

KR 10-2013-0044764 A 5/2013
KR 10-2017-0090162 A 8/2017

*Primary Examiner* — Cristi J Tate-Sims
(74) *Attorney, Agent, or Firm* — Birch, Stewart, Kolasch & Birch, LLP

(57) ABSTRACT

A laundry processing apparatus and a driving method thereof for driving a laundry processing apparatus by executing an artificial intelligence (AI) algorithm and/or machine learning algorithm in a 5G environment connected for the Internet of Things are provided. The driving method may include obtaining a drive current of a motor and a rotational speed of a drum during a cycle of the laundry processing apparatus, classifying a type of load of laundry located inside the laundry processing apparatus based on the obtained drive current and rotational speed, determining whether to change a course of the laundry processing apparatus according to the type of load, outputting a recommended course corresponding to the type of load when a course change of the laundry processing apparatus is determined, and changing the cycle of the laundry processing apparatus to the recommended course upon receiving a selection signal for the recommended course.

8 Claims, 13 Drawing Sheets

1

(51) Int. Cl.

| | |
|---|---|
| ***D06F 34/18*** | (2020.01) |
| *D06F 34/28* | (2020.01) |
| *D06F 103/04* | (2020.01) |
| *D06F 103/06* | (2020.01) |
| *D06F 103/24* | (2020.01) |
| *D06F 103/26* | (2020.01) |
| *D06F 103/46* | (2020.01) |
| *D06F 105/02* | (2020.01) |
| *D06F 105/52* | (2020.01) |
| *D06F 105/56* | (2020.01) |
| *D06F 105/58* | (2020.01) |
| *D06F 105/60* | (2020.01) |
| *D06F 34/05* | (2020.01) |
| *D06F 101/20* | (2020.01) |

(52) U.S. Cl.

CPC ..... *D06F 2101/20* (2020.02); *D06F 2103/04* (2020.02); *D06F 2103/06* (2020.02); *D06F 2103/24* (2020.02); *D06F 2103/26* (2020.02); *D06F 2103/46* (2020.02); *D06F 2105/02* (2020.02); *D06F 2105/52* (2020.02); *D06F 2105/56* (2020.02); *D06F 2105/58* (2020.02); *D06F 2105/60* (2020.02)

(56) References Cited

U.S. PATENT DOCUMENTS

| | | | | |
|---|---|---|---|---|
| 2014/0326067 | A1* | 11/2014 | Chanda | G01N 9/30 73/32 R |
| 2015/0047128 | A1* | 2/2015 | Goshgarian | D06F 34/18 8/137 |
| 2018/0305851 | A1* | 10/2018 | Kwon | D06F 39/08 |
| 2020/0040509 | A1* | 2/2020 | Shinohara | D06F 39/00 |

* cited by examiner

APPARATUS FOR TREATING LAUNDRY AND METHOD FOR OPERATING THE SAME

CROSS-REFERENCE TO RELATED APPLICATION

This present application claims benefit of priority to Korean Patent Application No. 10-2019-0087856, entitled "APPARATUS FOR TREATING LAUNDRY AND METHOD FOR OPERATING THE SAME" and filed on Jul. 19, 2019, in the Korean Intellectual Property Office, the entire disclosure of which is incorporated herein by reference.

BACKGROUND

1. Technical Field

The present disclosure relates to a laundry processing apparatus and a driving method thereof, and more particularly, to a laundry processing apparatus capable of performing laundry processing in an optimal pattern that matches load characteristics using artificial intelligence and a machine learning algorithm, and a driving method thereof.

2. Description of Related Art

A laundry processing apparatus corresponds to a device that performs laundry processing functions, such as washing and drying laundry. When laundry is put into the laundry processing apparatus, the user determines a washing course according to the type of laundry, the volume or weight of the laundry, and the degree of contamination of the laundry, and determines, for example, whether the laundry is to be soaked, the number of times the laundry is to be washed, rinsed, and dehydrated, and whether the laundry is to be dried. When a parameter value corresponding to a predetermined course is inputted to the laundry processing apparatus, the laundry processing apparatus operates according to the inputted parameter value.

Meanwhile, as a recent technology introduced to laundry processing apparatuses, an amount of laundry may be measured using a weight sensor, and the type of laundry may be detected through a camera.

In particular, Related Art 1 discloses a technique for a control method of a washing device that senses the weight of the laundry, photographs the inside of the drum, senses the volume of the laundry in the drum with the photographed image, and calculates the density of the laundry based on the sensed volume and weight to sense the fabric of the laundry.

Moreover, Related Art 2 discloses a washing machine control system that senses the type of laundry using a camera, and selects a washing course according to the type of laundry.

That is, in the case of Related Art 1 and Related Art 2, it is possible to select the washing course according to the type of load, so that a washing cycle according to the load characteristics may be performed. However, Related Art 1 and Related Art 2 are related to determining what the load (laundry) is based on image processing (camera), and thus the cost is increased since imaging equipment for acquiring an image is required.

The above-described related art is technical information retained by the inventor to derive the present disclosure or acquired by the inventor while deriving the present disclosure, and thus should not be construed as publicly known art that was known prior to the filing date of the present disclosure.

RELATED ART DOCUMENTS

Related Art 1: Korean Patent Application Publication No. 10-2017-0090162 (published Aug. 7, 2017)

Related Art 2: Korean Patent Application Publication No. 10-2013-0044764 (published May 3, 2013)

SUMMARY OF THE INVENTION

One aspect of the present disclosure is to improve the performance of a laundry processing apparatus by enabling laundry processing to be performed in an optimal pattern that matches the load characteristics, by using an artificial intelligence and/or machine learning algorithm.

Another aspect of the present disclosure is to analyze the type of load even if a user selects a course that does not correspond to the load of the laundry, and recommend a course and/or change the course corresponding to the load, thereby improving the ease of use and the user satisfaction.

Another aspect of the present disclosure is to reduce the cost and improve the performance of the laundry processing apparatus by using a machine learning algorithm, without adding a separate component, to classify the type of load of the laundry.

Another aspect of the present disclosure is to improve user satisfaction with a laundry processing apparatus by predicting an Unbalance Error (UE) and providing an alarm regarding the UE to a user.

Another aspect of the present disclosure is to precisely classify a load as a load in which the laundry can flow or a load in which the laundry cannot flow, by using a machine learning algorithm, thereby acquiring a refined result.

Another aspect of the present disclosure is to accumulate usage data of the user to update a machine learning algorithm, thereby improving a user's product reliability regarding a laundry processing apparatus and improving performance of a laundry processing apparatus.

Another aspect of the present disclosure is to provide a user with a recommended course and a notification regarding whether a UE has occurred, through at least one of a laundry processing apparatus, a user terminal, or an AI speaker, thereby improving the user's satisfaction.

Aspects of the present disclosure are not limited to the above-mentioned aspects, and other aspects and advantages of the present disclosure, which are not mentioned, will be understood through the following description, and will become apparent from the embodiments of the present disclosure. Furthermore, it will be understood that aspects and advantages of the present disclosure may be achieved by the means set forth in the claims and combinations thereof.

A driving method of a laundry processing apparatus according to an embodiment of the present disclosure may include performing laundry processing in an optimal pattern suitable for load characteristics, by using an artificial intelligence and/or machine learning algorithm.

The driving method of a laundry processing apparatus according to an embodiment of the present disclosure may include obtaining a drive current of a motor and a rotational speed of a drum during a cycle of the laundry processing apparatus, classifying a type of load of laundry located inside the laundry processing apparatus based on the obtained drive current of the motor and rotational speed of the drum, determining whether to change a course of the laundry processing apparatus according to the type of load, outputting a recommended course corresponding to the type of load when a course change of the laundry processing apparatus is determined, and changing the cycle of the laundry processing apparatus to the recommended course upon receiving a selection signal for the recommended course.

Through the driving method of a laundry processing apparatus according to this embodiment of the present disclosure, it is possible to analyze the type of load even if a user selects a course that does not correspond to the load of the laundry, and recommend a course and/or change the course corresponding to the load, thereby improving the ease of use and the user satisfaction.

In addition, the classifying of the type of load of the laundry may include analyzing a change trend of the drive current of the motor and the rotational speed of the drum, and classifying the type of load of the laundry based on the change trend.

Furthermore, the obtaining of the drive current of the motor and the rotational speed of the drum may include obtaining the drive current of the motor and the rotational speed of the drum in a first motion interval, which is a cycle before water is supplied, and a second motion interval, which is a cycle after water is supplied.

In addition, the obtaining of the drive current of the motor and the rotational speed of the drum may include extracting data to obtain the drive current of the motor and the rotational speed of the drum when a set time elapses after the measured RPM of the rotational speed of the drum reaches a preset RPM.

In addition, the classifying of the type of load of the laundry may include, in the extracting of the data, classifying the load as a first load in which the laundry does not flow when the measured values of the drive current of the motor and the rotational speed of the drum have a regular period, and classifying the load as a second load in which the laundry does flow when the measured values of the drive current of the motor and the rotational speed of the drum do not have a regular period.

Through the classifying and obtaining the type of load of laundry according to this embodiment of the present disclosure, it is possible to reduce the cost and improve the performance of the laundry processing apparatus by using a machine learning algorithm, without adding a separate component, to classify the type of load of the laundry.

In addition, the classifying of the type of load of the laundry may include classifying the type of load from the drive current of the motor and the rotational speed of the drum obtained during a cycle of the laundry processing apparatus by using a deep neural network that is pre-trained to classify the type of load from the drive current of the motor and the rotational speed of the drum during an operation of the laundry processing apparatus.

Through the classifying of the type of load of laundry according to an embodiment of the present disclosure, it is possible to precisely classify a load as a load in which the laundry can flow or a load in which the laundry cannot flow, by using a machine learning algorithm, thereby acquiring a refined result so that the user's reliability of the laundry processing apparatus may be improved.

In addition, the determining of whether to change the course may include predicting whether an unbalance error (UE) has occurred by detecting an amount of change in the drive current of the motor and the rotational speed of the drum, and determining whether to change a course of the laundry processing apparatus when the UE occurrence is predicted.

Through the determining of whether to change the course according to this embodiment of the present disclosure, it is possible to improve user satisfaction with a laundry processing apparatus by predicting an Unbalance Error (UE) and providing an alarm to a user.

In addition, the outputting of the recommended course may include outputting the recommended course through a speaker provided in the laundry processing apparatus.

In addition, the outputting of the recommended course may include outputting the recommended course through a user terminal connected to the laundry processing apparatus via a network, and outputting content including a reason for changing to the recommended course to the user terminal.

Through the outputting of the recommended course according to an embodiment of the present disclosure, it is possible to provide a user with a recommended course and a notification regarding whether a UE has occurred through at least one of a laundry processing apparatus, a user terminal, or an AI speaker, thereby improving a user's satisfaction.

In addition, the changing to the recommended course may include changing a cycle of the laundry processing apparatus to the recommended course upon receiving a spoken utterance including a selection of the recommended course.

Through the changing to the recommended course according to this embodiment of the present disclosure, it is possible to improve the performance of a laundry processing apparatus by enabling laundry processing to be performed in an optimal pattern that matches the load characteristics, by using an artificial intelligence and/or machine learning algorithm.

A laundry processing apparatus according to another embodiment of the present disclosure may include an acquisition unit configured to obtain a drive current of a motor and a rotational speed of a drum during a cycle of the laundry processing apparatus, an analysis unit configured to classify a type of load of laundry located inside the laundry processing apparatus based on the obtained drive current of the motor and rotational speed of the drum, a setting unit configured to determine whether to change a course of the laundry processing apparatus in correspondence to the type of load, a recommendation unit configured to output a recommended course corresponding to the type of load when a course change of the laundry processing apparatus is determined, and an operation control unit configured to change the cycle of the laundry processing apparatus to the recommended course upon receiving a selection signal for the recommended course.

Through a laundry processing apparatus according to this embodiment of the present disclosure, even if the user selects a course that does not correspond to the load of the laundry, the type of load may be analyzed to recommend a course or automatically change the course corresponding to the load during the cycle of the laundry processing apparatus, thereby improving the convenience of use and satisfaction with laundry processing apparatus.

In addition, the analysis unit may analyze a change trend of the drive current of the motor and the rotational speed of the drum, and classify the type of load of the laundry based on the change trend.

Furthermore, the acquisition unit may obtain the drive current of the motor and the rotational speed of the drum in a first motion interval, which is a cycle before water is supplied, and a second motion interval, which is a cycle after water is supplied.

In addition, the acquisition unit may extract data to obtain the drive current of the motor and the rotational speed of the drum when a set time elapses after the measured RPM of the rotational speed of the drum reaches a preset RPM.

In addition, when the data extraction is performed, the analysis unit may classify the load as a first load in which the laundry does not flow when the measured values of the drive current of the motor and the rotational speed of the drum have a regular period, and classify the load as a second load in which the laundry does flow when the measured values of the drive current of the motor and the rotational speed of the drum do not have a regular period.

Through the analysis unit and the acquisition unit according to this embodiment of the present disclosure, it is possible to reduce the cost and improve the performance of the laundry processing apparatus by using a machine learning algorithm, without adding a separate component, to classify the type of load of the laundry.

In addition, the analysis unit may classify the type of load from the drive current of the motor and the rotational speed of the drum obtained during a cycle of the laundry processing apparatus by using a deep neural network that is pre-trained to classify the type of load from the drive current of the motor and the rotational speed of the drum during an operation of the laundry processing apparatus.

Through the analysis unit according to this embodiment of the present disclosure, it is possible to precisely classify a load as a load in which the laundry can flow or a load in which the laundry cannot flow, by using a machine learning algorithm, thereby acquiring a refined result so that the user's reliability of the laundry processing apparatus may be improved.

In addition, the analysis unit may predict whether an unbalance error (UE) has occurred by detecting an amount of change in the drive current of the motor and the rotational speed of the drum, and the setting unit may determine whether to change a course of the laundry processing apparatus when the UE occurrence is predicted.

Through the analysis unit and the setting unit according to this embodiment of the present disclosure, by predicting an unbalance error (UE) and providing an alarm to notify the user to take an action according to the occurrence of the UE, so that the user's satisfaction and convenience of the laundry processing apparatus may be improved.

In addition, the recommendation unit may output the recommended course through a speaker provided in the laundry processing apparatus.

In addition, the recommendation unit may output the recommended course through a user terminal connected to the laundry processing apparatus via a network, and output content including a reason for changing to the recommended course to the user terminal.

Through the recommendation unit according to this embodiment of the present disclosure, it is possible to provide a user with a recommended course and a reason for changing to the recommended course, through at least one of a laundry processing apparatus, a user terminal, or an AI speaker, thereby improving a user's satisfaction.

In addition, the operation unit may change a cycle of the laundry processing apparatus to the recommended course upon receiving a spoken utterance including a selection for the recommended course.

Through the operation control unit according to this embodiment of the present disclosure, it is possible to improve the performance of a laundry processing apparatus by enabling laundry processing to be performed in an optimal pattern that matches the load characteristics, by using an artificial intelligence and/or machine learning algorithm.

In addition, in order to implement the present disclosure, there may be further provided other methods, other systems, and a computer-readable recording medium having a computer program stored thereon to execute the methods.

Other aspects, features, and advantages other than those described above will become apparent from the following drawings, claims, and detailed description of the present disclosure.

According to embodiments of the present disclosure, it is possible to improve the performance of a laundry processing apparatus by enabling laundry processing to be performed in an optimal pattern that matches the load characteristics, by using an artificial intelligence and/or machine learning algorithm.

In addition, by analyzing the type of load even if a user selects a course that does not correspond to the load of the laundry to recommend a course and/or change the course corresponding to the load, it is possible to improve the ease of use and the user satisfaction.

In addition, it is possible to reduce the cost and improve the performance of the laundry processing apparatus by using a machine learning algorithm without adding a separate part to classify the type of load of the laundry.

In addition, it is possible to improve user satisfaction with a laundry processing apparatus by predicting an Unbalance Error (UE) and providing an alarm to a user.

In addition, it is possible to precisely classify a load as a load in which the laundry can flow or a load in which the laundry cannot flow, by using a machine learning algorithm, thereby acquiring a refined result.

In addition, it is possible to accumulate usage data of the user to update a machine learning algorithm, thereby improving a user's product reliability regarding a laundry processing apparatus and improving performance of a laundry processing apparatus.

In addition, it is possible to provide a user with a recommended course and a notification regarding whether a UE has occurred through at least one of a laundry processing apparatus, a user terminal, or an AI speaker, thereby improving a user's satisfaction.

In addition, although the laundry processing apparatus is a mass-produced uniform product, the user may recognize the laundry processing apparatus as a personalized device, and thus experience the effect of a user-specific product.

Effects of the present disclosure are not limited to the effects mentioned above, and other effects not mentioned may be clearly understood by those skilled in the art from the following description.

BRIEF DESCRIPTION OF THE DRAWINGS

The foregoing and other aspects, features, and advantages of the present disclosure, as well as the following detailed description of the embodiments, will be better understood when read in conjunction with the accompanying drawings. For the purpose of illustrating the present disclosure, there is shown in the drawings an exemplary embodiment, it being understood, however, that the present disclosure is not intended to be limited to the details shown since various modifications and structural changes may be made therein without departing from the spirit of the present disclosure and within the scope and range of equivalents of the claims.

The use of the same reference numerals or symbols in different drawings indicates similar or identical items.

DETAILED DESCRIPTION

Figure 1:
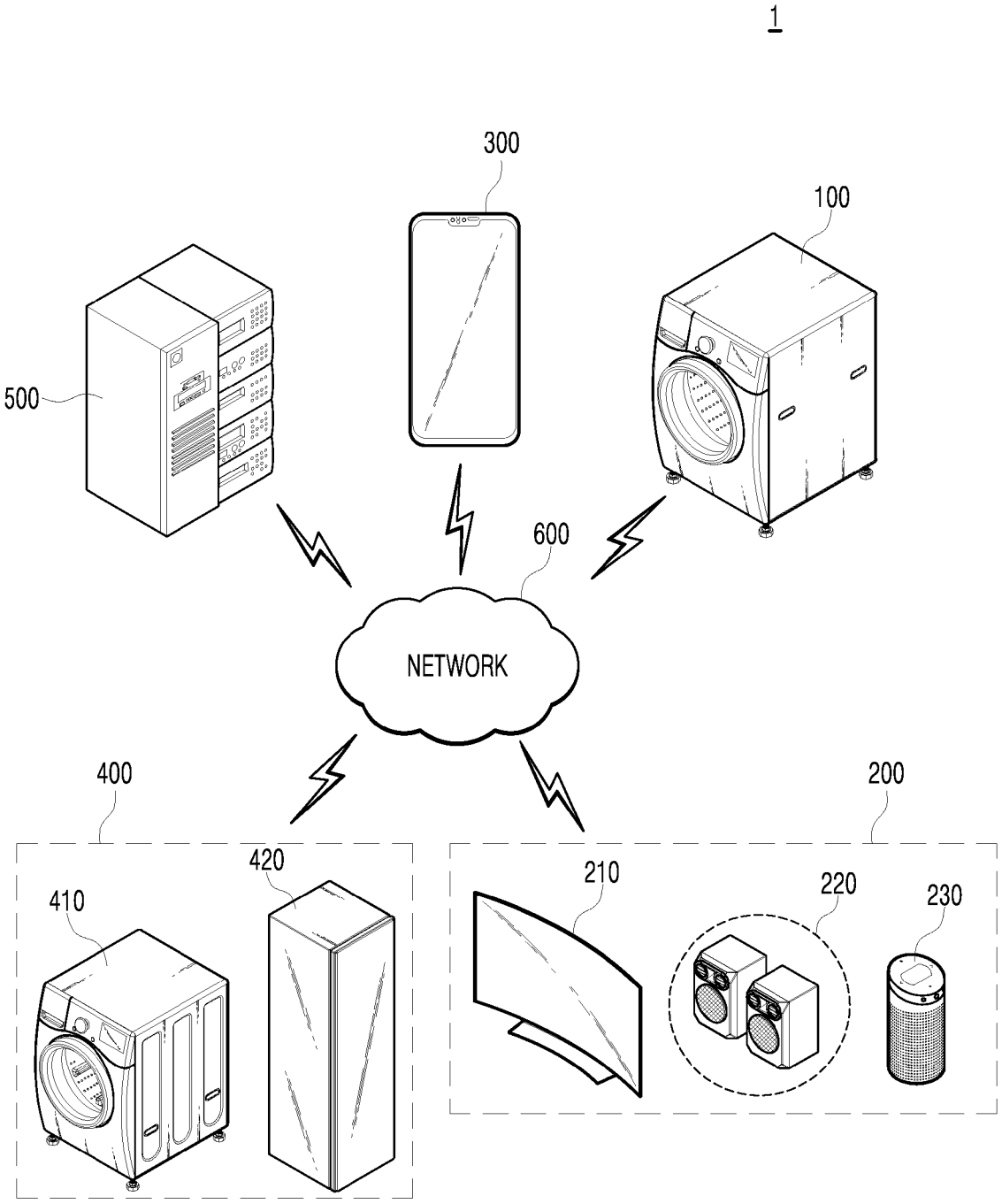
FIG. 1 is a diagram illustrating a laundry processing environment including a laundry processing apparatus, an output device, a user terminal, an interworking device, a server, and a network connecting these components to each other according to an embodiment of the present disclosure.

Advantages and features of the present disclosure and methods for achieving them will become apparent from the descriptions of aspects herein below with reference to the accompanying drawings. However, the description of particular example embodiments is not intended to limit the present disclosure to the particular example embodiments disclosed herein, but on the contrary, it should be understood that the present disclosure is to cover all modifications, equivalents and alternatives falling within the spirit and scope of the present disclosure. The example embodiments disclosed below are provided so that the present disclosure will be thorough and complete, and also to provide a more complete understanding of the scope of the present disclosure to those of ordinary skill in the art. In the interest of clarity, not all details of the relevant art are described in detail in the present specification in so much as such details are not necessary to obtain a complete understanding of the present disclosure.

The terminology used herein is used for the purpose of describing particular example embodiments only and is not intended to be limiting. As used herein, the singular forms "a," 'an,' and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. Although the terms "first", "second", and the like may be used herein to describe various elements, these elements should not be limited by these terms. These terms may be only used to distinguish one element from other elements.

Hereinafter, embodiments of the present disclosure will be described in detail with reference to the accompanying drawings. Like reference numerals designate like elements throughout the specification, and overlapping descriptions of the elements will not be provided.

FIG. 1 is a diagram illustrating a laundry processing environment including a laundry processing apparatus, an output device, a user terminal, an interworking device, a server, and a network connecting these components to each other according to an embodiment of the present disclosure.

Referring to FIG. 1, a laundry processing environment 1 may include a laundry processing apparatus 100, an output device 200, a user terminal 300, an interworking device 400, a server 500, and a network 600.

The laundry processing apparatus 100 is a device that processes laundry through various operations such as washing, dehydration, and/or drying. The laundry processing apparatus 100 may include a washing machine for removing contaminants from laundry using water and detergent, a dehydrator for spinning the drum loaded with wet laundry at high speed so as to dehydrate the laundry, a dryer for drying the laundry by supplying dry air into the drum into which the laundry is put, and a dryer combined washing machine having a drying function and a washing function. Hereinafter, the detailed structure of the laundry processing apparatus 100 will be described with reference to FIG. 2.

In this embodiment, the laundry processing apparatus 100 may receive service request information from a user for controlling the laundry processing apparatus 100. A method for the laundry processing apparatus 100 to receive the service request information from the user may include receiving a touch (or button input) signal to the user interface (UI) 120 in FIG. 3 from the user, and receiving a spoken utterance corresponding to the service request from the user.

In the present embodiment, the laundry processing apparatus 10 may be provided in a predetermined space (for example, a home, a company, and a hospital), and may search for one or more output devices 200 disposed in the same space as the laundry processing apparatus 100 and outputting at least one of an audio signal or a video signal, and may adjust the output signals of the one or more output devices 200 found corresponding to the operation mode of the laundry processing apparatus 100. Here, the operation mode of the laundry processing apparatus 100 may include, for example, a status notification mode for notifying a current operation state of the laundry processing apparatus 100, or a content playback mode for playing content. In addition, the laundry processing apparatus 100 may select at least one of the one or more output devices 200 found corresponding to the operation mode, and transmit at least one of an audio signal or a video signal to the selected output device 200.

Here, selecting the output device 200 may include, in the status notification mode which outputs the current operation state of the laundry processing apparatus 100 (for example, the washing cycle state information currently being performed) through a UI and a speaker (171 in FIG. 3) of the laundry processing apparatus 100, selecting one output device 200 for outputting current operation state information (a video signal, for example, the progress of the laundry processing), selecting one output device 200 for outputting a voice relating to the current operation state information (an audio signal), or selecting one output device 200 to output the current operation state information and the voice relating to the current operation state information.

Also, selecting the output device 200 may include selecting one output device 200 to output a video signal included in the content in the content playback mode, or selecting one output device 200 to output an audio signal included in the content, or selecting one output device 200 to output the video signal and the audio signal included in the content. Here, "content" may include a concept that collectively refers to digital information or individual information elements, which are composed of items such as text, symbols, voice, sound, sound sources, images, and video (video and audio). Such content may include, for example, data such as text, images, videos, sound sources, links (for example, web links), or a combination of at least two of these data. In particular, in the present embodiment, the content may include, for example, text, an image, or a video for explaining the reason for changing to the recommended course or explaining that the laundry cannot be unwound due to an unbalance error (UE).

The output device 200 is an electronic device that outputs at least one of an audio signal or a video signal, and may include, for example, a TV 210, a two-channel speaker 220, an AI speaker 230, and a speaker itself. In this embodiment, although the output device 200 is described as the above-described electronic devices, the output device 200 is not limited thereto, and may include various home appliances (for example, a dryer, a clothes processing device, an air conditioner, a refrigerator, and a cleaner).

The user terminal 300 may be provided with a service for driving or controlling the laundry processing apparatus 100 through an authentication process after accessing a laundry processing apparatus driving application or a laundry processing apparatus driving website. In the present embodiment, the user terminal 300 that completes the authentication process may drive the laundry processing apparatus 100 and control the operation of the laundry processing apparatus 100.

In the present embodiment, the user terminal 300 may be a desktop computer, a smartphone, a notebook, a tablet PC, a smart TV, a cell phone, a personal digital assistant (PDA), a laptop, a media player, a micro server, a global positioning system (GPS) device, an electronic book terminal, a digital broadcast terminal, a navigation device, a kiosk, an MP3 player, a digital camera, a home appliance, and other mobile or immobile computing devices operated by the user, but is not limited thereto. Furthermore, the user terminal 300 may be a wearable terminal having a communication function and a data processing function, such as a watch, glasses, a hair band and a ring. The user terminal 300 is not limited to the above-mentioned devices, and thus any terminal that supports web browsing may be used as the user terminal 300.

Meanwhile, in the present embodiment, the laundry processing apparatus 100 may interwork with the interworking device 400 in order to process laundry, in particular, clothes, and control the interworking device 400. For example, the interworking device 400 may include a dryer 410 and a laundry processing device 420. That is, in this embodiment, the laundry processing apparatus 100 may analyze the type of laundry, particularly, clothes, automatically set the operation mode of the dryer 410 and the laundry processing device 420 in correspondence to the analysis result, and control the dryer 410 and the laundry processing device 420 to operate according to the operation mode.

The server 500 may be a database server, which provides big data required for applying a variety of artificial intelligence algorithms and data for operating the laundry processing apparatus 100. Furthermore, the server 500 may include a web server or application server for remotely controlling the laundry processing apparatus 100 by using a laundry processing apparatus driving application or a laundry processing apparatus driving web browser installed in the user terminal 300.

Artificial intelligence is an area of computer engineering science and information technology that studies methods to make computers mimic intelligent human behaviors such as reasoning, learning, self-improving, and the like.

In addition, artificial intelligence (AI) does not exist on its own, but is rather directly or indirectly related to a number of other fields in computer science. In recent years, there have been numerous attempts to introduce an element of AI into various fields of information technology to solve problems in the respective fields.

Machine learning is an area of artificial intelligence that includes the field of study that gives computers the capability to learn without being explicitly programmed. More specifically, machine learning is a technology that investigates and builds systems, and algorithms for such systems, which are capable of learning, making predictions, and enhancing their own performance on the basis of experiential data. Machine learning algorithms, rather than only executing rigidly set static program commands, may be used to take an approach that builds models for deriving predictions and decisions from inputted data.

The server 500 may receive and analyze service request information from the laundry processing apparatus 100, generate service response information corresponding to the service request information, and transmit the service response information to the laundry processing apparatus 100. In particular, the server 500 may receive the spoken utterance corresponding to the service request of the user from the laundry processing apparatus 100, generate the processing result of the spoken utterance as service response information through the voice recognition process, and provide the processing result to the laundry processing apparatus 100. Here, according to the processing capacity of the laundry processing apparatus 100, the spoken utterance corresponding to the above-described service request of the user may be recognized and generated as service response information in the laundry processing apparatus 100.

The network 600 may serve to connect the laundry processing apparatus 100, the output device 200, the user terminal 300, the interworking device 400, and the server 500. The network 600 may include a wired network such as a local area network (LAN), a wide area network (WAN), a metropolitan area network (MAN), or an integrated service digital network (ISDN), and a wireless network such as a wireless LAN, a CDMA, Bluetooth®, or satellite communication, but the present disclosure is not limited to these examples. The network 400 may also send and receive information using short distance communication and/or long distance communication. The short distance communication may include Bluetooth®, radio frequency identification (RFID), infrared data association (IrDA), ultra-wideband (UWB), ZigBee, and Wi-Fi (wireless fidelity) technologies, and the long distance communication may include code division multiple access (CDMA), frequency division multiple access (FDMA), time division multiple access (TDMA), orthogonal frequency division multiple access (OFDMA), and single carrier frequency division multiple access (SC-FDMA).

The network 600 may include a connection of network elements such as hubs, bridges, routers, switches, and gateways. The network 600 may include one or more connected networks, including a public network such as the Internet and a private network such as a secure corporate private network. For example, the network may include a multi-network environment. Access to the network 600 may be provided via one or more wired or wireless access networks. Furthermore, the network 600 may support 5G communication and/or an Internet of things (IoT) network for exchanging and processing information between distributed components such as objects.

Figure 2:
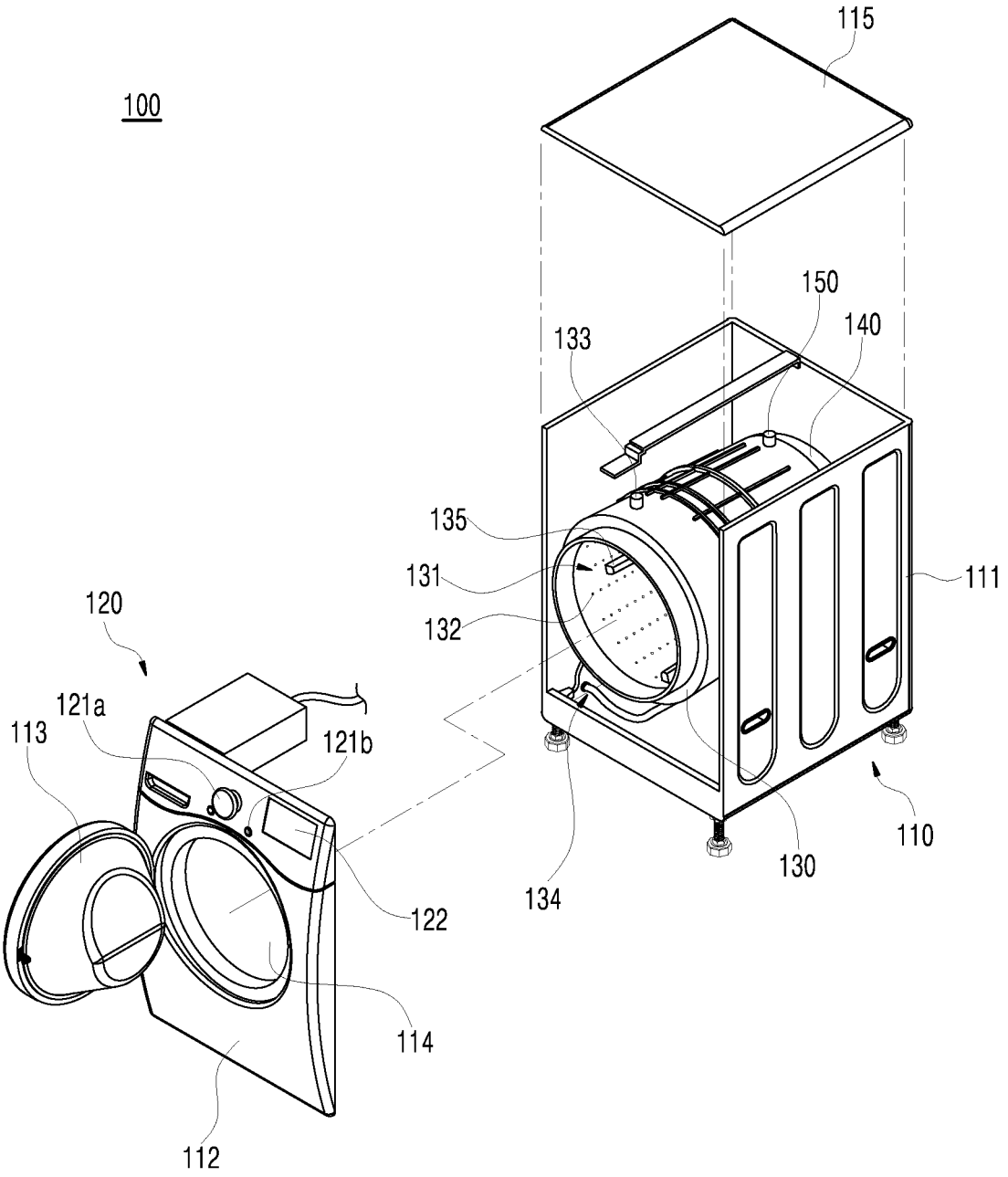
FIG. 2 is a diagram illustrating schematically the structure of a laundry processing apparatus according to an embodiment of the present disclosure.

FIG. 2 is a diagram illustrating schematically the structure of a laundry processing apparatus according to an embodiment of the present disclosure. In the following description, description of parts overlapping with those of FIG. 1 will be omitted.

Referring to FIG. 2, the laundry processing apparatus 100 may include a cabinet 110 forming the exterior of the laundry processing apparatus 100, a tub 130 provided in the cabinet 110 and supported by the cabinet 110, a drum 131 rotatably provided inside the tub 130 and into which laundry is put, a driving unit 140 for rotating the drum by applying torque to the drum 131, and a UI 120 that allows a user to select and execute a wash course. Here, the driving unit 140 may include a motor, for example, and the UI 120 may include an input interface 121 and an output interface 122.

In addition, the cabinet 110 may include a main body 111, a cover 112 provided on the front surface of the main body 111, and a top plate 115 coupled to an upper part of the main body 111. The cover 112 may include an opening part 114 provided to allow the access of the laundry, and a door 113 for selectively opening and closing the opening part 114. The drum 131 may form a space for washing the laundry put into the inside, and rotate by receiving power from the driving unit 140. Furthermore, since the drum 131 has a plurality of through holes 132, washing water stored in the tub 130 may be introduced into the drum 131 through the through holes 132, and the washing water inside the drum 131 may flow to the tub 130. Therefore, when the drum 131 is rotated, the laundry introduced into the drum 131 may have dirt removed therefrom in the process of rubbing with the wash water stored in the tub 130. In addition, the drum 131 may further include a lifter 135 for stirring the laundry.

The UI 120 is a component that allows a user to input information related to the wash (including the entire cycle process of the laundry processing apparatus 100), and also identifies information related to the wash. That is, the UI 120 is a component for providing an interface with the user. Accordingly, the UI 120 may include input interfaces 121*a* and 121*b* through which a user may input a control command, and an output interface 122 for displaying control information according to the control command. In addition, the UI 120 may include a control unit (192 in FIG. 3) for controlling the driving of the laundry processing apparatus 100, including the operation of the driving unit 140 according to a control command. In the present embodiment, the UI 120 may refer to a control panel capable of input and output for control of the laundry processing apparatus 100. For this purpose, the UI 120 may be configured as a touch recognition display controller or various other input/output controllers. As an example, the touch recognition display controller may provide an output interface and an input interface between the device and the user. The touch recognition display controller may transmit and receive electrical signals with the control unit 192. Also, the touch recognition display controller may display a visual output to the user, and the visual output may include text, graphics, images, video, and a combination thereof. The UI 120 may be a display member such as an organic light emitting display (OLED) or a liquid crystal display (LCD) or a light emitting display (LED) capable of touch recognition, for example.

That is, in this embodiment, the UI 120 may perform the function of the input interface 121 receiving a predetermined control command so that the user may control the entire operation of the laundry processing apparatus 100. In addition, the UI 120 may function as the output interface 122 to display the operation state of the laundry processing apparatus 100 under the control of the control unit 192. In this embodiment, the UI 120 may display the operation mode setting and/or the recommendation result of the laundry processing apparatus 100 in correspondence to the type of the load for the laundry in the laundry processing apparatus 100. In addition, the UI 120 may output content including, for example, a reason for changing to the recommended course, and an explanation of a situation in which the laundry cannot be unwound due to a UE. The UI 120 may display an operation mode setting result of the interworking device 400 interworking with the laundry processing apparatus 100. As an optional embodiment, the UI 120 may display a user-specific wash mode recommendation result based on a result of analyzing a user preference. Furthermore, the UI 120 may display content and information in response to a user selection.

In addition, in this embodiment, the laundry processing apparatus 100 may include at least one water supply hose (not shown) for guiding water supplied from an external water source such as a faucet to the tub 130, and a water supply unit 133 for controlling at least one water supply hose. The laundry processing apparatus 100 may include a dispenser (not shown) for supplying additives such as detergent and fabric softener into the tub 130 or the drum 131, and additives may be accommodated in the dispenser according to their types. The dispenser may include a detergent receiving part (not shown) for receiving detergent and a softening agent receiving part (not shown) for receiving fabric softener. Further, the laundry processing apparatus 100 may include a water supply pipe (not shown) for selectively guiding water supplied through the water supply unit 133 to each receiving part of the dispenser. The water supply unit 133 may include a water supply valve for regulating each water supply pipe, and the water supply pipe may include water supply pipes to supply water to the detergent receiving part and the fabric softener receiving part, respectively.

Meanwhile, the drain unit 134 may include a drain port (not shown) for discharging water from the tub 130, and a pump (not shown) for pumping the discharged water. The pump may selectively perform a function of pumping the discharged water into a drain pipe (not shown) and a function of pumping the discharged water into a circulation pipe (not shown). Here, the water which is pumped by the pump and guided along the circulation pipe may be referred to as circulating water. The pump may include an impeller (not shown) for pumping water, a pump housing (not shown) for receiving the impeller, and a pump motor (not shown) for rotating the impeller. The pump housing is provided with an inlet port (not shown) through which water is introduced, a drain discharge port (not shown) through which the water pumped by the impeller is discharged to the drain pipe, and a circulating water discharge port (not shown) for discharging the water pumped by the impeller into the circulation pipe. Here, the pump motor may be capable of forward/reverse rotation. That is, in this embodiment, depending on the direction in which the impeller is rotated, water may be discharged through the drain discharge port, or water may be discharged through the circulating water discharge port. Such a configuration may be implemented by appropriately designing the structure of the pump housing, and since this technique is well known, a detailed description thereof will be omitted.

The pump may be capable of varying the flow rate (or discharge water pressure), and for this, the pump motor constituting the pump may be a variable speed motor capable of controlling the rotational speed. The pump motor may be a brushless direct current motor (BLDC motor), but is not limited thereto. A driver for controlling the speed of the motor may be further provided, and the driver may be an inverter driver. The inverter driver may convert AC power to DC power, and input the DC power to the motor at the target frequency. In addition, the pump motor may be controlled by a control unit. The control unit may be configured to include a proportional-integral controller (PI controller) and a proportional-integral-derivative controller (PID controller). The control unit may receive an output value (for example, an output current) of the pump motor as an input, and control the output value of the driver so that the rotational speed of the pump motor follows a predetermined target rotational speed based on the input. In addition, the control unit may control the overall operation of the washing machine as well as the pump motor.

In the present embodiment, the laundry processing apparatus 100 may include at least one balancer (not shown) on the front surface of the tub 130 along the perimeter of the tub 130. The balancer is for reducing the vibration of the tub 130. The balancer may be a weight having a predetermined weight, and may be provided in plurality. For example, balancers may be respectively provided at both the left and right sides of the front surface of the tub 130 and a balancer may be provided at the lower part of the front surface of the tub 130.

Figure 3:
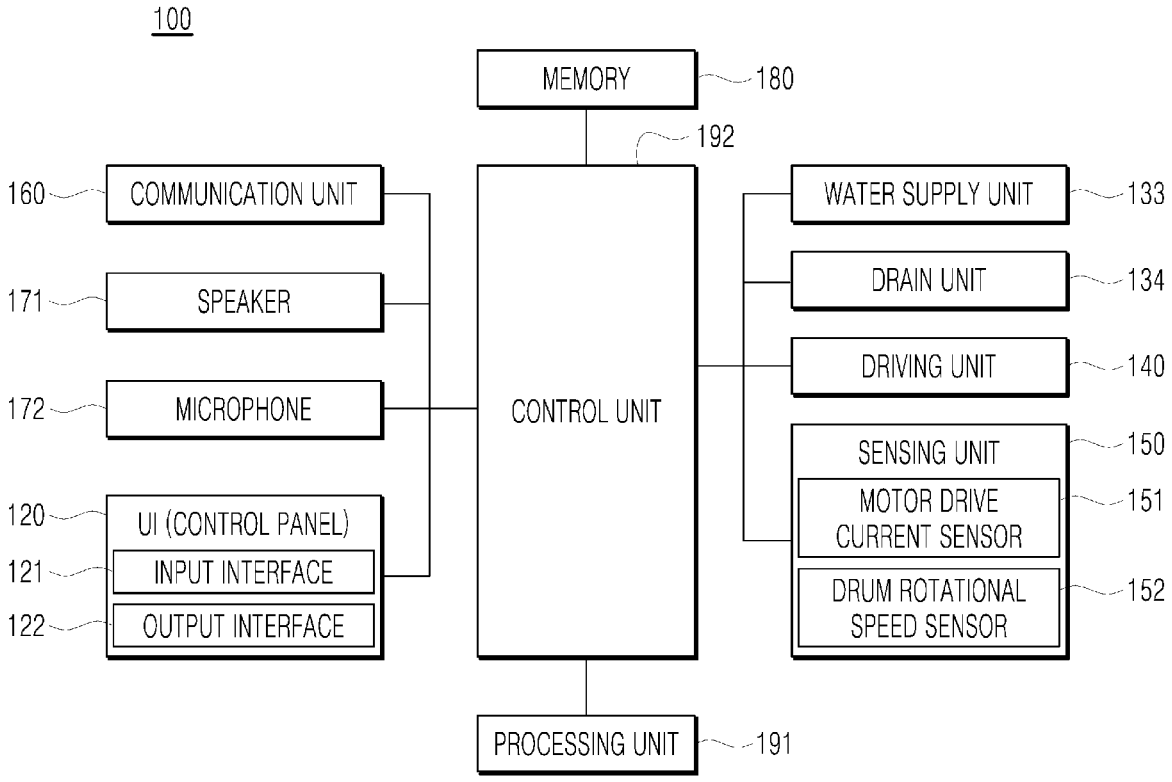
FIG. 3 is a schematic block diagram of a laundry processing apparatus according to an embodiment of the present disclosure.

A sensing unit 150 may be configured to essentially include a motor drive current sensor (151 in FIG. 3) and a drum rotational speed sensor (152 in FIG. 3). Among other sensors not shown, a sensor for sensing chemicals remaining in the wash water, and an olfactory sensor for sensing a contaminated laundry quality may be additionally provided in the sensing unit 150. In addition, foreign substances included in laundry may be sensed through a reflected wave generated by a wave sensor (not shown). For example, when laundry includes metal such as coins, foreign substances such as coins may be detected by using characteristics of the reflected wave of the wave sensor. The motor drive current sensor senses the driving current of the motor, and the drum rotational speed sensor senses the rotational speed of the drum to output sensed data based on laundry type sensing. Meanwhile, in the present embodiment, the location of the sensing unit 150 is illustrated as being provided at the upper part of the tub 130, but the present disclosure is not limited thereto. The sensors included in the sensing unit 150 may be located at different locations. For example, the motor drive current sensor may be provided at the motor side, and the drum rotational speed sensor may be provided in the drum.

FIG. 3 is a schematic block diagram of a laundry processing apparatus according to an embodiment of the present disclosure. In the following description, description of parts overlapping with those of FIGS. 1 and 2 will be omitted.

Referring to FIG. 3, the laundry processing apparatus 100 may include a communication unit 160, a speaker 171, a microphone 172, a memory 180, a processing unit 191, and a control unit 192.

The communication unit 160, interworking with the network 600, may provide a communication interface required to provide signals transmitted/received between the laundry processing apparatus 100, the output device 200, the user terminal 300, the interworking device 400, and/or the server 500, in the form of packet data. Furthermore, the communication unit 160 may support various kinds of object-to-object intelligent communication (such as Internet of things (IoT), Internet of everything (IoE), and Internet of small things (IoST)), and may support communication such as machine to machine (M2M) communication, vehicle to everything (V2X) communication, and device to device (D2D) communication.

The speaker 171 may output information related to the operation of the laundry processing apparatus 100 as auditory data. That is, under the control of the control unit 192, the speaker 171 may output information related to the operation of the laundry processing apparatus 100 as audio data, and may output, as audio, a warning sound, notification messages indicating, for example, an operation mode, an operation state, and an error state, information corresponding to a user's voice command, and a processing result corresponding to the user's voice command. In addition, the speaker 171 may convert an electrical signal from the control unit 192 into an audio signal, and output the audio signal. Further, the speaker 171 may output an audio signal (for example, music playback) from a device capable of wired and wireless communication with the laundry processing apparatus 100. However, as one exemplary embodiment, the speaker 171 is not limited in terms of its position and implementation method, and may include all output means for outputting an audio signal.

Under the control of the control unit 192, the microphone 172 may receive a spoken utterance uttered by the user toward the laundry processing apparatus 100. In addition, in this embodiment, a plurality of microphones may be provided so as to more accurately receive the user's spoken utterance. Here, each of the plurality of microphones may be spaced apart from each other at different positions, and may process the received spoken utterance of the user as an electrical signal. In this embodiment, a voice recognition unit (not shown) may be included to perform voice recognition of a spoken utterance of a user received through the microphone 172. The voice recognition unit may use various noise removal algorithms to remove noise generated while receiving the spoken utterance of the user. As a selective embodiment, the voice recognition unit may include various components for processing a voice signal, such as a filter (not shown) for removing noise when a user receives a spoken utterance, and an amplifier (not shown) for amplifying and outputting a signal outputted from the filter. However, as one exemplary embodiment, the microphone 172 is not limited in terms of its position and implementation method, and other input means for inputting an audio signal may be applied without limitation.

The memory 180 may store information that supports various functions of the laundry processing apparatus 100. The memory 180 may store a plurality of applications or application programs executed in the laundry processing treatment 100, and various information and instructions for operating the laundry processing apparatus 100. At least some of such application programs may be downloaded from an external server through wireless communication. In addition, the memory 180 may store user information of one or more users who intend to interact with the laundry processing apparatus 100. Such user information may include facial information and body shape information (for example, photographed by an image recognition unit (not shown) or a biometric recognition unit (not shown)), and voice information, which may be used to identify who the recognized user is.

Also, the memory 180 stores a wake-up word that may drive the laundry processing apparatus 100, and the processing unit 191 may recognize when the user utters the wake-up word, and change the laundry processing apparatus 100 from an inactive state to an active state. In addition, the memory 180 may store work information to be performed by the laundry processing apparatus 100 in correspondence to a voice command of the user (for example, a command for controlling the laundry processing apparatus 100). In addition, in the present embodiment, the memory 180 may store overall cycle information of the laundry processing apparatus 100, performance information of the output device 200 and the interworking device 400, characteristic information of a user, which may specify that the user is a corresponding user (for example, face information, voice information), and a mode and option of the laundry processing apparatus 100 to be set in the case of a specific user. Here, the mode and option of the laundry processing apparatus 100 may mean a cycle to be performed, an order of cycles, and a detailed driving method during the entire cycle. In addition, the performance information of the output device 200 and the interworking device 400 may include output strength information, channel number information, and various other types of information representing output performance.

In the present embodiment, the memory 180 may serve to temporarily or permanently store data processed by the control unit 192. Here, the memory 180 may include magnetic storage media or flash storage media, but the scope of the present disclosure is not limited thereto. This memory 180 may include an internal memory and/or an external memory and may include a volatile memory such as a DRAM, a SRAM or a SDRAM, and a non-volatile memory such as one time programmable ROM (OTPROM), a PROM, an EPROM, an EEPROM, a mask ROM, a flash ROM, a NAND flash memory or a NOR flash memory, a flash drive such as an SSD, a compact flash (CF) card, an SD card, a Micro-SD card, a Mini-SD card, an XD card or memory stick, or a storage device such as a HDD.

The processing unit 191 may classify the type of load of the laundry located in the laundry processing apparatus 100 by obtaining the driving current of the motor and the rotational speed of the drum during the cycle of the laundry processing apparatus 100. In addition, the processing unit 191 may determine whether to change the course of the laundry processing apparatus 100 according to the type of load, and when it is determined to change the course of the laundry processing apparatus 100, may output a recommended course corresponding to the type of the load. Then, upon receiving a selection signal for the recommended course, the processing unit 191 may change the course of the laundry processing apparatus 100 to the recommended course. In addition, the processing unit 191 may classify the type of load from the driving current of the motor and the rotational speed of the drum during the cycle of the laundry processing apparatus 100 using the pre-trained deep neural network, so that it may classify the type of load from the driving current of the motor and the rotational speed of the drum during the operation of the laundry processing apparatus 100.

In the present embodiment, the processing unit 191 may be provided outside the control unit 192, as shown in FIG. 3, may be provided inside the control unit 192 and operate as the control unit 192, and may be provided inside the server (500 in FIG. 1). Hereinafter, a detailed operation of the processing unit 191 will be described with reference to FIG. 6.

The control unit 192 may control the entire operation of the laundry processing apparatus 100 by driving control software installed in the memory 180 as a kind of central processing device. In the present embodiment, the control unit 192 may classify the type of load of the laundry located in the laundry processing apparatus 100 by obtaining the driving current of the motor and the rotational speed of the drum. Then, the control unit 192 may determine whether to change the course of the laundry processing apparatus 100 according to the type of load, and if it is determined to change the course of the laundry processing apparatus 100, may output the recommended course corresponding to the type of load and control the laundry processing apparatus 100 to operate according to the recommended course.

In the present embodiment, the laundry processing apparatus 100 is provided with paddles (not shown) inside the drum (131 in FIG. 2), so that laundry may be caught on the paddles so as to rotate as the drum rotates, and accordingly, the laundry may fall from the top to the bottom of the drum. The movement characteristics of the laundry may be related to the weight and the volume, that is, the density of the laundry, and the density may be related to the type of laundry. Therefore, the type of laundry may be acquired through the movement characteristics of the laundry according to the drum rotation. Here, the movement characteristics of the laundry may be ascertained based on the driving current of the motor and the rotational speed of the drum. That is, in this embodiment, the type of load of the laundry may be classified through the driving characteristic of the laundry processing apparatus 100.

Figure 4:
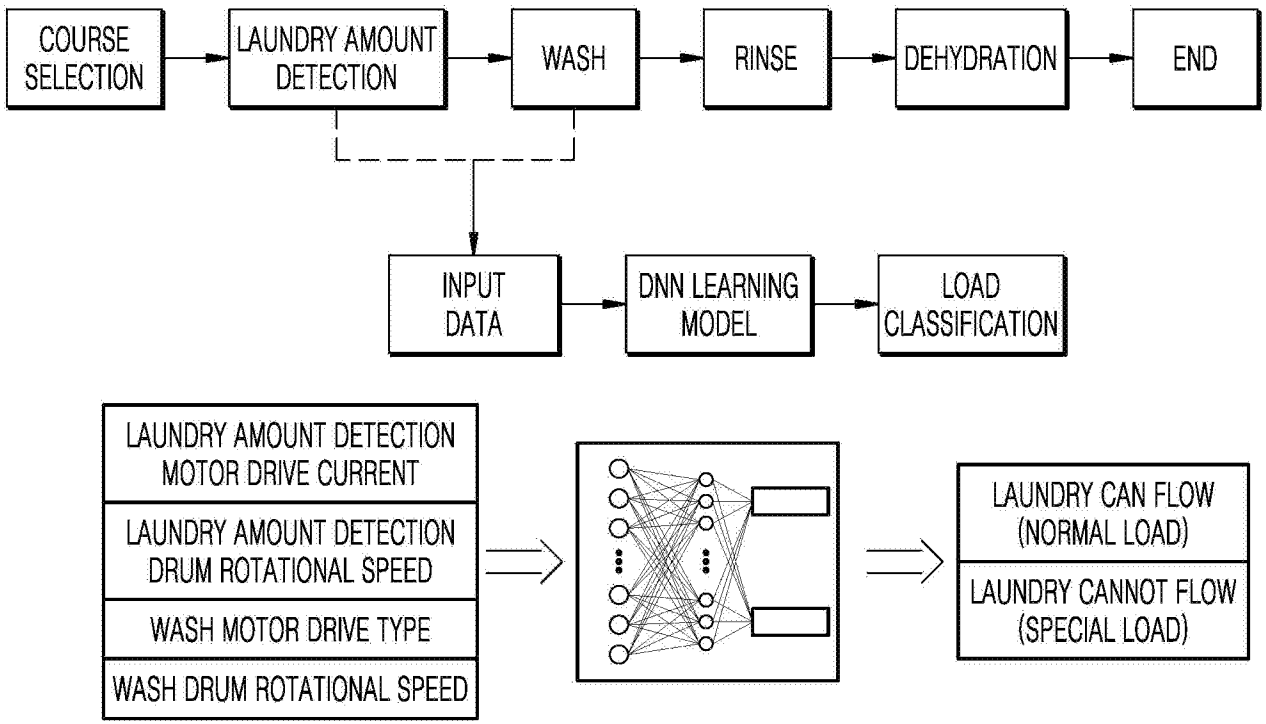
FIG. 4 is a schematic diagram illustrating a load classification process of a laundry processing apparatus according to an embodiment of the present disclosure.

FIG. 4 is a schematic diagram illustrating a load classification process of a laundry processing apparatus according to an embodiment of the present disclosure. Referring to FIG. 4, when a course selection is inputted by a user, the control unit 192 may perform laundry amount detection, a wash cycle, a rinse cycle, and a dehydration cycle according to a predetermined process in correspondence to the inputted course.

More specifically, when the wash operation is performed by the user's operation, the control unit 192 may determine an amount of water suitable for the laundry and the wash time by determining the weight of the laundry accommodated in the drum, that is, the load. Then, the control unit 192 may cause a predetermined amount of wash water to be supplied into the tub through the water supply unit 133 so as to wet the laundry inside the drum. At this time, the control unit 192 may allow the detergent and the fabric softener to be supplied to the tub through a detergent supply device connected to the water supply unit 133. Thereafter, after the wash water of the set amount is supplied, the drum is rotated in forward and reverse directions by driving of the driving unit 140, and at this time, the control unit 192 may wash the laundry by repeating a process of a lifter inside the drum to lift and then drop the laundry inside the drum. After the wash cycle is completed, the control unit 192 may cause the contaminated wash water in the tub to be drained through the drain unit 134, and when the wash water drain is completed, may supply new wash water to perform a rinse cycle. After the rinse cycle is completed, the contaminated wash water in the tub may be drained through the drain unit 134, and laundry dispersion, in which the tangled laundry in the wash cycle and the rinse cycle is untangled, may be performed. Then, after the laundry dispersion of the rinse cycle is completed, the control unit 192 may perform a dehydration cycle while proceeding with detection of an unbalance of laundry in the drum, detection of excessive bubbles, and detection of a water full phenomenon.

That is, in this embodiment, in order to perform an optimal wash, the laundry processing apparatus 100 should determine the amount of water suitable for the laundry and the wash time by determining the laundry received in the drum, that is, the characteristics of the load such as the weight and type of the load, and select a course that corresponds to the load. However, when the user is to determine the type of the load (laundry) and select the course of the laundry processing apparatus 100, the user is burdened with having to individually select the course each time. Thus, for example, a situation may occur in which even when a user is washing a blanket, a normal course may be performed due to the course input being burdensome. As such, the laundry processing apparatus 100 may not operate at an optimal performance.

Accordingly, in this embodiment, the control unit 192 may receive input of the driving current of the motor from the motor drive current sensor 151 of the sensing unit 150, receive input of the rotational speed of the drum from the drum rotational speed sensor 152, and input the received inputs as input data to a previously learned deep neural network. In this manner, the control unit 192 may classify the load as a normal load or a special load as the result of the deep learning. Here, the control unit 192 may receive input of the driving current of the motor and the rotational speed of the drum in a laundry amount detection interval and a wash cycle interval. Further, in the wash cycle interval, input may be received of the driving current of the motor and the rotational speed of the drum during motion having a regular RPM, such as a tumbling motion and a rolling motion. That is, in this embodiment, by using, as input data, the drive current of the motor in the laundry amount detection interval, the rotational speed of the drum in the laundry amount detection interval, the drive current of the motor in the laundry amount detection interval, and the rotational speed of the drum in the wash cycle interval, output data of normal and special loads may be obtained through a deep neural network model based on supervised learning. However, the input data is not limited thereto.

Meanwhile, in the present embodiment, the drum of the laundry processing apparatus 100 may be driven in various forms. That is, the driving of the drum may be performed in various forms in addition to the normal tumble drive and spin drive. Tumble drive is a drum driving motion that drops the laundry after the laundry is lifted up during the washing or rinsing of a typical drum washing machine, and spin drive is a drum driving motion in which laundry is continuously rotated while the laundry is attached to the drum during dehydrating. In this embodiment, the drum driving motion may refer to the RPM of the drum, and also a motion in which laundry flows in the drum in relation thereto. The drum driving motion refers to a combination of the rotational direction and rotational speed of the drum, and a dropping direction and a dropping time of the laundry located inside the drum may change due to the drum driving motion, and thus the flow of the laundry in the drum may change. The drum driving motion may be implemented by the control unit 192 controlling the driving unit 140. Since the laundry is lifted by the lift provided on the inner circumferential surface of the drum when the drum rotates, the impact applied to the laundry may be changed by controlling the rotational speed and the rotation direction of the drum. That is, mechanical forces such as friction between laundry, friction between laundry and wash water, and drop impact of laundry may be varied. In other words, for washing, the amount of contact or rubbing of the laundry may be changed, and the degree of dispersion or inversion of the laundry may be changed. Therefore, in the present embodiment, by providing a control method of the laundry processing apparatus 100 having a variety of drum driving motions depending on the type of laundry, the degree of contamination of the laundry, each cycle, and the detailed steps of each cycle, the drum driving motion may be changed in order to process the laundry with the optimum mechanical power. As such, the washing efficiency of the laundry may be improved.

The rolling motion is a motion in which the driving unit 140 rotates the drum in one direction by the control of the control unit 192, and the laundry on the inner circumferential surface of the drum is controlled to drop to the lowest point of the drum at a position less than about 90 degrees in the rotational direction of the drum. That is, when the driving unit 140 rotates the drum at about 40 RPM, the laundry located at the lowest point of the drum rises to a certain height along the rotational direction of the drum and then flows, as if rolling, to the lowest point of the drum at a position less than about 90 degrees from the lowest point of the drum. Visually, the laundry may be rolled continuously in three quadrants of the drum when the drum rotates clockwise. Through the rolling motion, the laundry may be washed through friction with the wash water, friction between pieces of the laundry, and friction with the drum inner surface. Through these motions, the laundry is sufficiently overturned such that the effect of gently washing the laundry is obtained.

Here, the rotational speed (RPM) of the drum may be determined in relation to the radius of the drum. That is, as the rotational speed (RPM) of the drum increases, centrifugal force is generated in the laundry in the drum. Due to the difference in magnitude between the centrifugal force and the force of gravity, the flow of laundry in the drum changes. Naturally, the rotational force of the drum and the friction between the drum and the laundry should also be taken into account. Therefore, in relation to the rolling motion, the RPM of the drum may be determined such that the centrifugal force and the frictional force are less than the force of gravity (1G).

The tumbling motion is a motion in which the driving unit 140 rotates the drum in one direction, and the laundry on the inner circumferential surface of the drum is controlled to drop to the lowest point of the drum at a position of about 90 degrees to about 110 degrees in the rotational direction of the drum. The tumbling motion is a drum driving motion that is generally used for washing and rinsing, since mechanical force is generated just by controlling the drum to rotate in one direction at an appropriate RPM. That is, the laundry put into the drum is located at the lowest point of the drum before the driving unit 140 is driven. When the driving unit 140 provides torque to the drum, the drum rotates, and the lift provided on the inner circumferential surface of the drum moves the laundry from the lowest point in the drum to a certain height. If the driving unit 140 rotates the drum at about 46 RPM, the laundry drops in the direction of the lowest point of the drum at a position of about 90 degrees to 110 degrees in the rotational direction at the lowest point of the drum. The tumbling motion may generate a centrifugal force greater than the centrifugal force in the rolling motion, but the RPM of the drum may be determined to generate less than the force of gravity. Visually, the tumbling motion is a form of motion in which the drum moves from the third quadrant to a part of the second quadrant at the lowest point of the drum when it is rotated clockwise, and then falls off the inner circumferential surface of the drum and drops to the lowest point of the drum. Thus, the tumbling motion allows the laundry to be washed by the impact forces caused by friction with the wash water and dropping, such that washing and rinsing may be performed with a mechanical force greater than that in the rolling motion. Since in the tumbling motion the laundry comes loose from the inside of the drum and falls by a certain extent, there is an effect of separating tangled laundry and dispersing the laundry.

The control unit 192 may output the recommended course through at least one of the communication unit 160, the speaker 171, or the output interface 122. When a recommended course selection signal is inputted by the user through at least one of the communication unit 160, the microphone 172, or the input interface 121, the control unit 192 may control one or more of the water supply unit 133, the drain unit 134, and the driving unit 140 according to the recommended course. That is, the control unit 192 may control the entire operation of the laundry processing apparatus 100 in correspondence to the type of load of the laundry located inside the laundry processing apparatus 100 during the entire cycle of the laundry processing apparatus 100. Meanwhile, in the present embodiment, when the recommended course selection signal is inputted by the user after the recommended course is outputted, this may be described as changing to the recommended course. However, when the user has preset the laundry processing apparatus 100 to allow the course to be automatically changed to the recommended course in response to the type of load of laundry, the course may be changed to the recommended course even if the recommended course selection signal from the user is not inputted.

In addition, as a selective embodiment, the control unit 192 may analyze the user's preference based on a manual operation signal of the laundry processing apparatus 100 of the user, and recommend a user-specific wash mode based on the analysis result of the user's preference.

Here, the control unit 192 may include any type of device capable of processing data, such as a processor. Here, the term "processor" may refer to a data processing device built in hardware, which includes physically structured circuits in order to perform functions represented as a code or command present in a program. Examples of the data processing device built in a hardware include, but are not limited to, processing devices such as a microprocessor, a central processing unit (CPU), a processor core, a multiprocessor, an application-specific integrated circuit (ASIC), a field programmable gate array (FPGA), and the like.

In the present embodiment, the control unit 192 may perform machine learning such as deep learning with respect to the type classification of load of laundry located inside the laundry processing apparatus 100, prediction on whether an Unbalance Error (UE) has occurred voice command acquisition, drive operation of the laundry processing apparatus 100 corresponding to the voice command, and a user-specific wash mode recommendation, and the memory 180 may store, for example, data used for the machine learning, and result data.

Deep learning, which is a subfield of machine learning, enables data-based learning through multiple layers. As the number of layers in deep learning increases, the deep learning network may acquire a collection of machine learning algorithms that extract core data from multiple datasets.

Deep learning structures may include an artificial neural network (ANN), and may include a convolutional neural network (CNN), a recurrent neural network (RNN), a deep belief network (DBN), and the like. The deep learning structure according to the present embodiment may use various structures well known in the art. For example, the deep learning structure according to the present disclosure may include a CNN, an RNN, a DBN, and the like. RNN is an artificial neural network structure which is formed by building up layers at each instance, and which is heavily used in natural language processing and the like and effective for processing time-series data which vary over a course of time. A DBN includes a deep learning structure formed by stacking up multiple layers of a deep learning scheme, restricted Boltzmann machines (RBM). A DBN has the number of layers formed by repeating RBM training. The CNN may include a model simulating a human brain function established on the assumption that when recognizing an object, a person extracts basic features of the objects, and then undergoes a complicated calculation in the brain to recognize the object on the basis of a result of the calculation.

Meanwhile, the artificial neural network can be trained by adjusting connection weights between nodes (if necessary, adjusting bias values as well) so as to produce desired output from given input. Also, the artificial neural network can continuously update the weight values through learning. Furthermore, methods such as back propagation may be used in training the artificial neural network.

That is, an artificial neural network may be installed in the laundry processing robot 100, and the control unit 192 may include an artificial neural network, for example, a deep neural network (DNN) such as a CNN, an RNN, and a DBN. Accordingly, the control unit 192 may learn a deep neural network for the type classification of load of laundry located inside the laundry processing apparatus 100, prediction on whether an Unbalance Error (UE) has occurred, voice command acquisition, drive operation of the laundry processing apparatus 100 corresponding to the voice command, and a user-specific wash mode recommendation. As a machine learning method for such an artificial neural network, both unsupervised learning and supervised learning may be used. The control unit 192 may control so as to update an artificial neural network structure after learning according to a setting.

Figure 5:
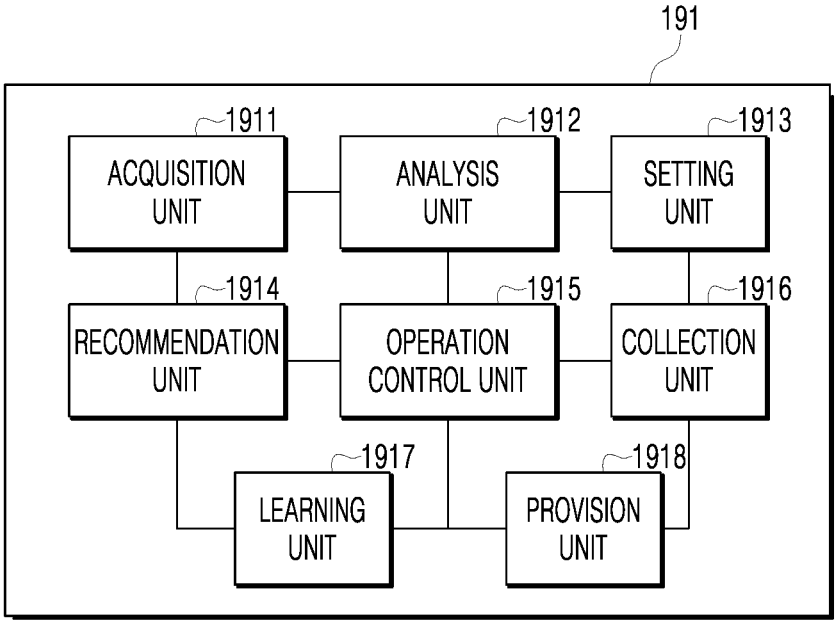
FIG. 5 is a schematic block diagram of a processing unit of a laundry processing apparatus according to an embodiment of the present disclosure.

FIG. 5 is a schematic block diagram of a processing unit of a laundry processing apparatus according to an embodiment of the present disclosure. In the following description, description of parts overlapping with those of FIGS. 1 to 4 will be omitted. Referring to FIG. 5, the processing unit 191 may include an acquisition unit 1911, an analysis unit 1912, a setting unit 1913, a recommendation unit 1914, an operation control unit 1915, a collection unit 1916, a learning unit 1917, and a provision unit 1918.

The acquisition unit 1911 may obtain the drive current of the motor and the rotational speed of the drum during the cycle of the laundry processing apparatus 100. That is, the acquisition unit 1911 may obtain the drive current of the motor from the motor drive current sensor 151 of the sensing unit (150 in FIG. 3), and obtain the rotational speed of the drum from the drum rotational speed sensor 152.

Meanwhile, the acquisition unit 1911 may, during the cycle of the laundry processing apparatus 100, obtain the drive current of the motor and the rotational speed of the drum in the first motion interval, which is a cycle before water is supplied, and the second motion interval, which is a cycle after water is supplied. For example, the first motion interval is a laundry amount detection interval, and before entering the wash cycle, the acquisition unit 1911 may acquire data for detecting a laundry amount and classifying load types of the laundry in a state in which water has not been supplied. That is, the acquisition unit 1911 may first acquire the drive current of the motor and the rotational speed of the drum in the laundry amount detection interval. The second motion interval may be, for example, a wash cycle interval, and the acquisition unit 1911 may acquire data for classifying load types for laundry after entering the wash cycle and supplying water. That is, the acquisition unit 1911 may acquire the drive current of the motor and the rotational speed of the drum in the wash cycle interval. However, the cycle of the laundry processing apparatus 100 may be classified into laundry amount detection, washing, rinsing, and dehydration. However, the rinsing and dehydration process may also be performed in the wash cycle interval.

Figure 6:
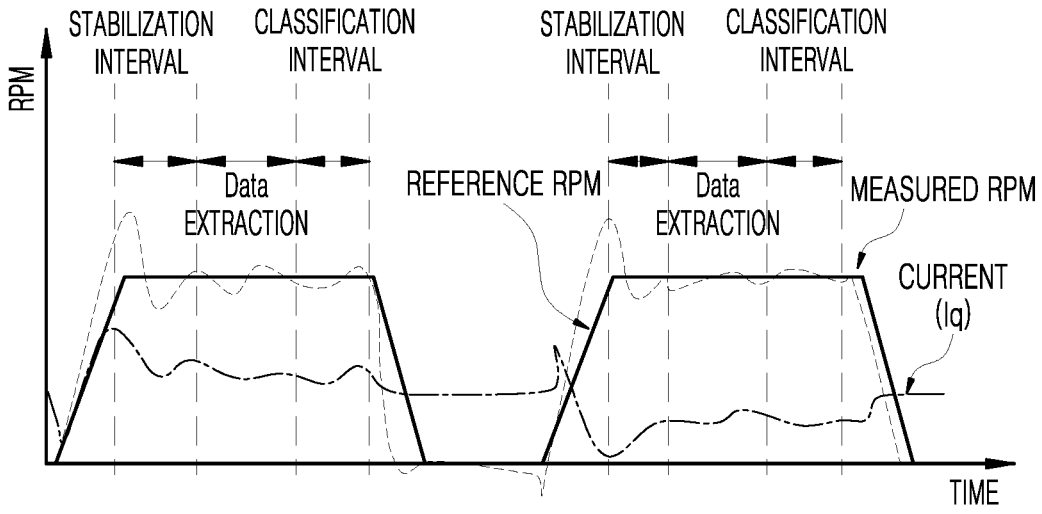
FIG. 6 is an exemplary diagram illustrating a data acquisition interval according to an embodiment of the present disclosure.

FIG. 6 is an exemplary diagram illustrating a data acquisition interval according to an embodiment of the present disclosure. Referring to FIG. 6, when a set time elapses after the measured RPM of the rotational speed (RPM) of the drum reaches a preset RPM, the acquisition unit 1911 may perform data extraction to obtain the drive current of the motor and the rotational speed of the drum. Here, in this embodiment, the set RPM may be set to a value within a predetermined range of the reference RPM which is the rotational speed of the drum set as the target. For example, the set RPM may be set to a rising threshold of the current measured RPM, and thus the rising threshold may be a value within a predetermined range of the reference RPM. That is, in this embodiment, after the rotational speed (RPM) of the drum is increased, that is, accelerated, such that the current measured RPM reaches the set RPM, a set time duration may be set as a stabilization interval for stable data extraction. The stabilization interval may be set to, for example, 5 seconds. In this embodiment, after passing through the stabilization interval, by setting a time period as a data extraction interval, the acquisition unit 1911 may be configured to acquire data (the rotational speed of the drum and the drive current of the motor). In addition, in this embodiment, after the data extraction interval, by setting a falling threshold at which the measured RPM drops, that is, when the rotational speed of the drum starts to decelerate, as a classification interval, the analysis unit 1912 (to be described below) may perform classification of load of the laundry. However, the set RPM, the reference RPM, the set time, a certain range, the rising threshold of the measured RPM, and the falling threshold of the measured RPM may be set differently for each cycle of the laundry processing apparatus 100. That is, the graph shown in FIG. 6 is an example of a pattern of a drive current of a motor and a rotational speed of a drum in a wash cycle interval performing a tumble motion having a constant RPM interval. For example, the stabilization interval, data extraction interval and classification interval in the laundry amount detection interval may be set to be shorter than the wash cycle. In addition, the stabilization interval and the classification interval may be omitted in the laundry amount detection interval.

The analysis unit 1912 may classify the type of load of the laundry located in the laundry processing apparatus 100 based on the drive current of the motor and the rotational speed of the drum acquired in the acquisition unit 1911. Here, the analysis unit 1912 may analyze a change trend of the drive current of the motor and the rotational speed of the drum, and classify the type of load of the laundry based on the change trend.

Figure 7:
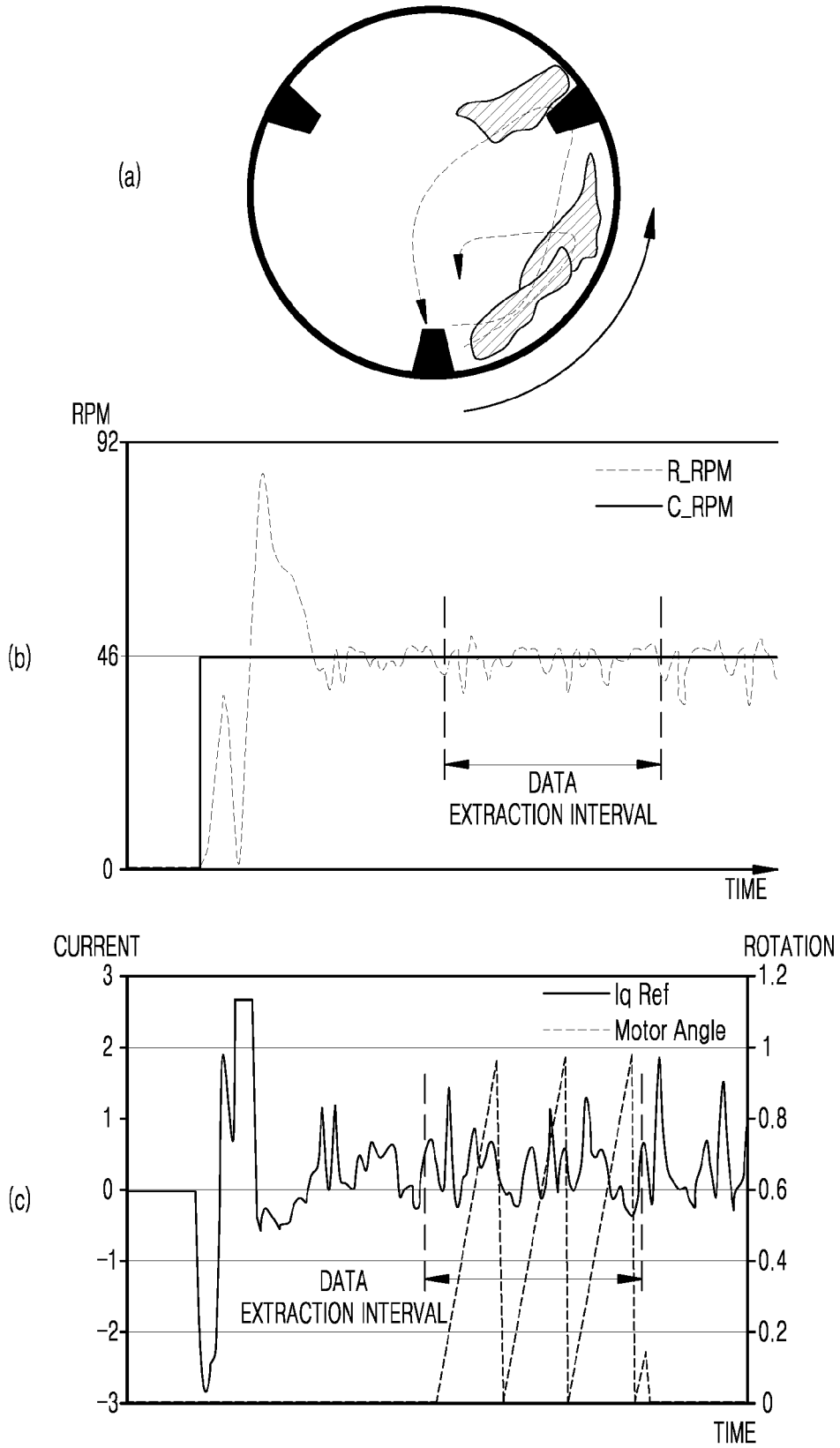
FIGS. 7 and 8 are exemplary diagrams illustrating load type classification control of a laundry processing apparatus according to an embodiment of the present disclosure.
Figure 8:
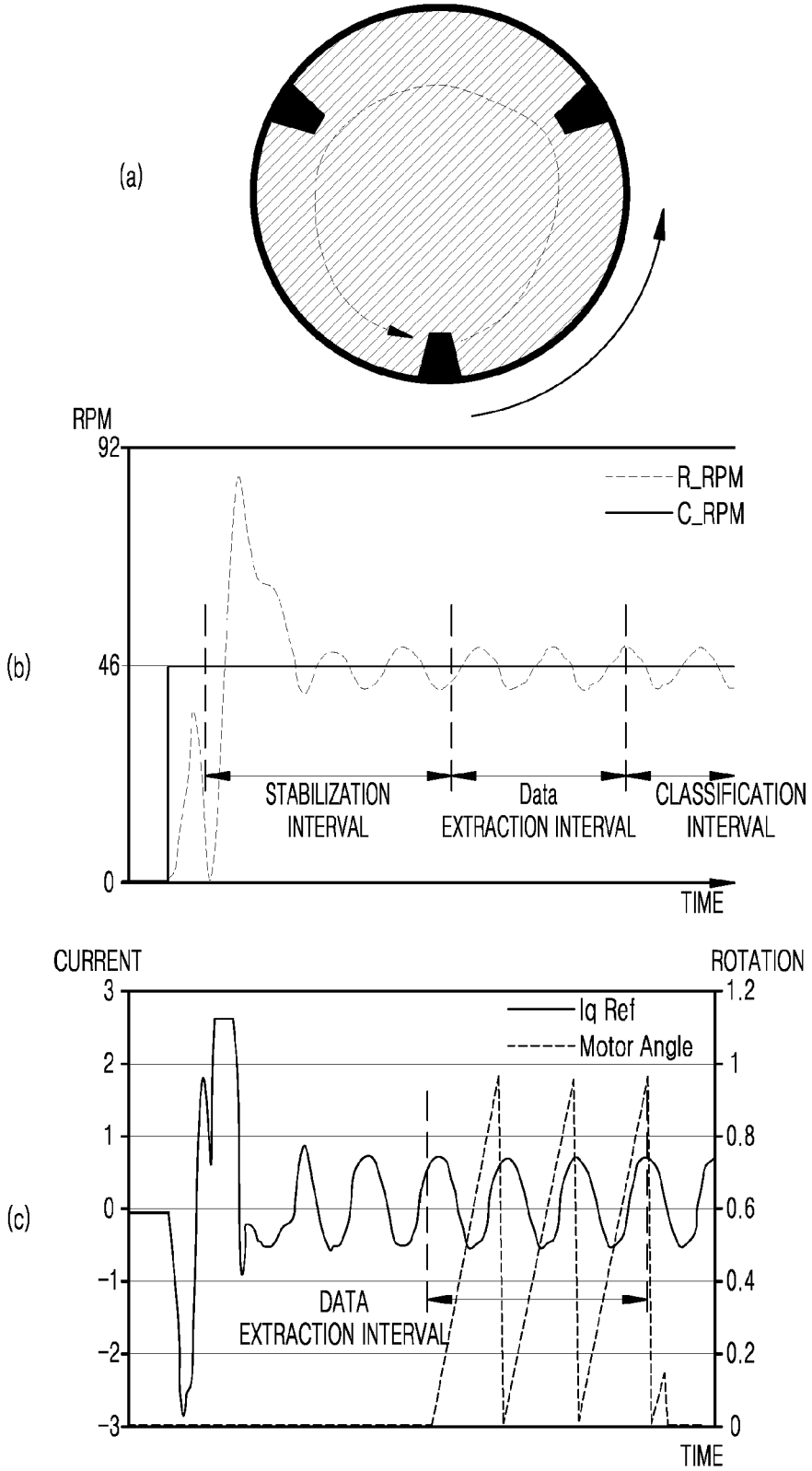

FIGS. 7 and 8 are exemplary diagrams illustrating load type classification control of a laundry processing apparatus according to an embodiment of the present disclosure. Referring to FIGS. 7 and 8, when the analysis unit 1912 performs data extraction, when the measured values of the drive current of the motor and the rotational speed of the drum have a regular period, the load may be classified as a first load in which the laundry does not flow, and when the measured values of the drive current of the motor and the rotational speed of the drum do not have a regular period, the load may be classified as a second load in which the laundry does flow. For example, the first load may be classified as a special load in which laundry cannot flow, and the second load may be classified as a normal load in which laundry can flow. The special load may refer to a bulky or large load, such as blanket.

Specifically, in this embodiment, FIG. 7(A) illustrates a state in which the laundry flows inside the drum (131 in FIG. 2), and FIG. 7(B) and FIG. 7(C) illustrate the driving characteristics of the laundry processing apparatus 100 with respect to the load in which the laundry flows. Referring to FIG. 7, in a case in which the laundry can flow, when the drum interior is not completely filled with laundry, it may be observed that, in the data extraction interval, the periodicity characteristics of the rotational speed C_RPM of the drum and the drive current IqRef of the motor are not shown. This is because in a state in which the drum of the laundry processing apparatus 100 is rotating at a constant speed, the laundry falls to the bottom of the drum due to the lifter (135 in FIG. 2) and the weight of the load itself, and the laundry flow occurs in various ways without the laundry falling to a certain position. That is, in relation to the second load, according to the impact of the laundry falling to the bottom of the drum, a change occurs in the rotational speed (RPM) of the drum, and due to this, the current control value changes, and thus an unpredictable current (drive current of the motor) pattern may occur.

In contrast, FIG. 8(A) shows a state in which laundry does not flow due to the drum being completely filled with laundry, and FIGS. 8(B) and 8(C) illustrate the operation characteristics of the laundry processing apparatus 100 for a load in which the laundry does not flow. Referring to FIG. 8, in the case in which the laundry cannot flow, when the drum interior is filled with laundry, in the data extraction interval it may be seen that the rotational speed C_RPM of the drum measured based on the preset rotational speed R_RPM of the drum operates with a regular period. In other words, based on the rotational speed of the drum and the drive current of the motor, it may be seen that the rotational speed of the drum of the first load and the drive current of the motor are characterized by a periodicity having one period when the motor rotates once, and the amplitude is characterized in proportion to the size of the unbalance. In this case, Request RPM (R_RPM) may mean a reference RPM value preset for the rotational speed of the drum, and Current RPM (C_RPM) may mean a measured RPM value currently measured for the rotational speed of the drum. In addition, IqRef may mean a current control value, that is, a drive current of the motor, and Motor Angle may mean a rotation angle of the motor.

However, during the cycle of the laundry processing apparatus 100, various situations may occur, such as when the laundry is a normal load in which the laundry can flow, but is unable to flow due to the laundry being stuck in the door, or when the laundry cannot flow but the drum is not completely filled with laundry and there is some space remaining. Accordingly, in the present embodiment, a pre-trained deep neural network may be used to more accurately analyze driving characteristics that appear according to the type of load of the laundry. That is, the analysis unit 1912 may classify the type of load from the driving current of the motor and the rotational speed of the drum during the operation of the laundry processing apparatus 100 by using a deep neural network that is pre-trained to classify the type of load from the driving current of the motor and the rotational speed of the drum during the cycle of the laundry processing apparatus 100. That is, in this embodiment, the type of load of laundry may be obtained from experimental results of the actual value and the predicted value of the drive current of the motor and the rotational speed of the drum by using deep learning during the cycle of the laundry processing apparatus 100.

Meanwhile, the analysis unit 1912 may predict whether an unbalance error (UE) has occurred, by detecting the amount of change in the drive current of the motor and the rotational speed of the drum. That is, in the present embodiment, the amount of eccentricity of the tub (130 in FIG. 2), that is, an unbalance (UB) of the tub, may be sensed in order to predict whether an unbalance error has occurred. For example, the eccentricity detection may be performed based on a ripple component of the drive current of the motor and/or the amount of change of rotational speed of the drum, which are sensed by the sensing unit 150.

In the present embodiment, when the analysis unit 1912 classifies the type of load of the laundry as a special load, if the unbalance of the laundry exceeds a reference value, vibration or noise may occur to a greater extent than for a normal load. Thus, in the present embodiment, it is possible to predict whether an unbalance error has occurred by measuring the degree of unbalance before entering the dehydration cycle interval, and comparing the measured unbalance degree with a reference value. The reference value may be set differently according to the laundry amount. For example, when the laundry amount is large, the inertia is large, and thus significant vibration occurs even for a small unbalance. Therefore, as the laundry amount increases, the reference value of the unbalance may be set to be smaller. Here, the unbalance degree uses an UB amount, and the UB amount may mean a value defined to determine the unbalance degree. This may be defined in various ways, and, for example, the UB amount may be obtained by multiplying constants obtained through experiments, the moment of inertia of the laundry in the drum, and the ripple, that is, the variation value, of the number of rotations of the motor when the motor is controlled to rotate the drum at a constant speed. Normally, the laundry amount group is set in plurality vertically according to the size of the laundry amount, and the reference UB amount corresponding to each laundry amount group may be set. Thus, the analysis unit 1912 may classify the type of load of laundry and determine whether the balance degree is less than or equal to the reference value using the reference UB amount corresponding to the laundry. For example, the laundry amount group may be divided into, for example, a small amount, a small-to-medium amount, a medium amount, and a large amount, and the reference UB amount may be set to correspond to each laundry amount group. Therefore, the analysis unit 1912 may measure the amount of UB before entering the dehydration cycle interval, and compare the measured UB amount with the reference UB amount corresponding to the type of load. When the measured UB amount is larger than the reference UB amount, it may be predicted that the dehydration cycle interval cannot be entered due to UE occurrence.

The setting unit 1913 may determine whether to change the course of the laundry processing apparatus 100 according to the type of load. In addition, the setting unit 1913 may determine whether to change the course of the laundry processing apparatus 100 when the UE occurrence is predicted. That is, the setting unit 1913 may determine whether to change the course of the laundry processing apparatus 100 when the type of load is a special load, and when the type of load is a special load and UE occurrence is predicted, the setting unit 1913 may determine whether to change the course of the laundry processing apparatus 100. For example, when the laundry is a blanket and a user selects a normal course, if the analysis result in the analysis unit 1912 is a special load, whether to change the course of the laundry processing apparatus 100 may be determined.

Figure 9:
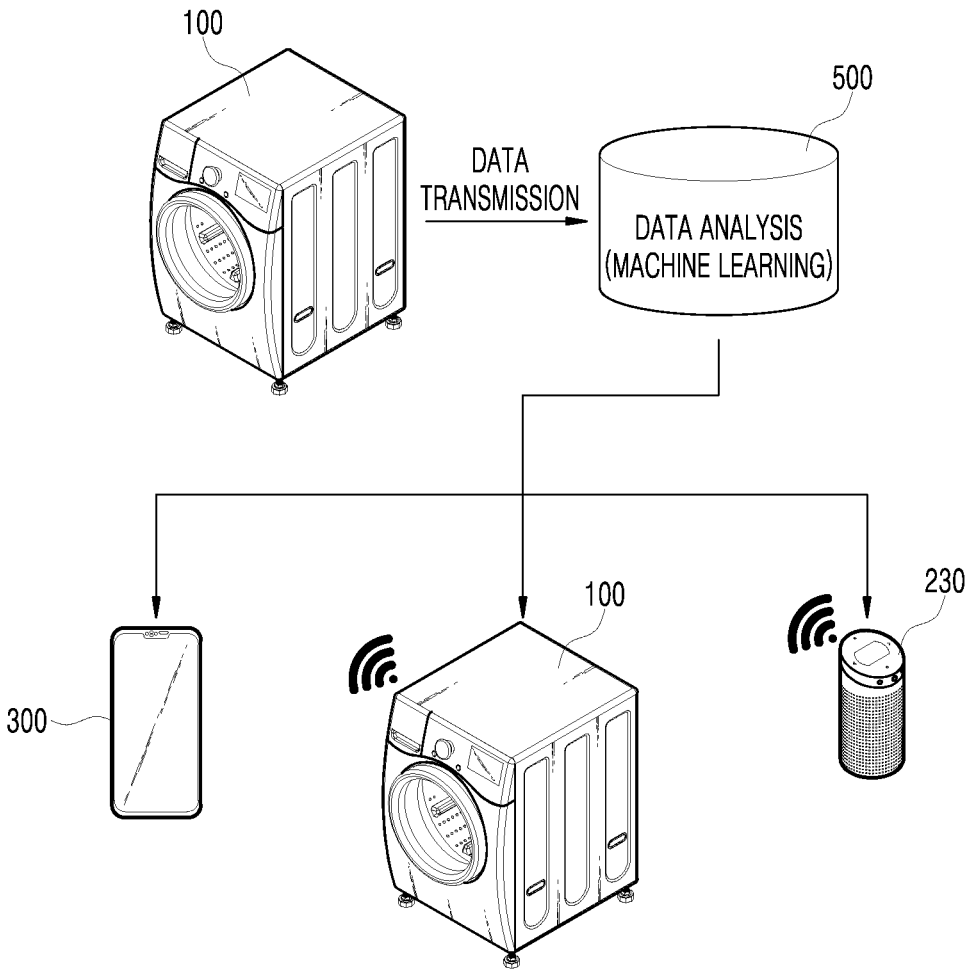
FIGS. 9 and 10 are exemplary diagrams illustrating a recommended course output of a laundry processing apparatus according to an embodiment of the present disclosure.
Figure 10:
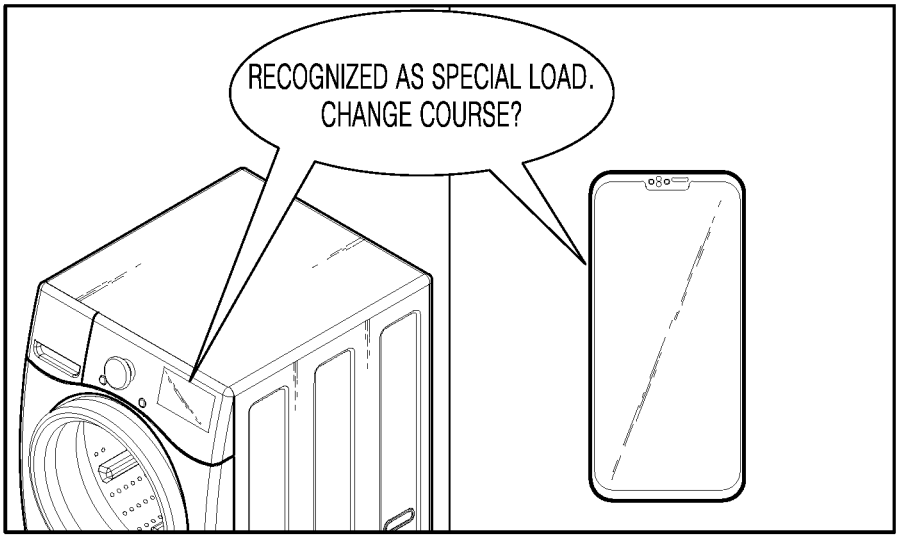

FIGS. 9 and 10 are exemplary diagrams illustrating a recommended course output of a laundry processing apparatus according to an embodiment of the present disclosure. In the following description, description of parts overlapping with those of FIGS. 1 to 8 will be omitted. Referring to FIG. 9, the laundry processing apparatus 100 may acquire the drive current of the motor and the rotational speed of the drum during the entire cycle, and transmit the obtained data to the server 500. In the server 500, for example, data analysis may be performed through machine learning to classify load types for laundry located in the laundry processing apparatus 100. Here, the data analysis may be performed by the control unit 192 and/or the processing unit 191 in the laundry processing apparatus 100 itself. Then, the laundry processing apparatus 100 may determine whether to change the course in correspondence to the type of load, and output a recommended course corresponding to the type of load through at least one of the laundry processing apparatus 100, the AI speaker 230, or the user terminal 300.

That is, when the recommendation unit 1914 determines to change the course of the laundry processing apparatus 100, the recommendation unit 1914 may output a recommended course corresponding to the type of load. For example, the recommendation unit 1914 may output a recommended course through, for example, a speaker or an output interface provided in the laundry processing apparatus 100. In addition, the recommendation unit 1914 may output a recommended course through the output device 200. In particular, the recommendation unit 1914 may output a recommended course through the AI speaker 230.

Further, referring to FIG. 10, the recommendation unit 1914 may output a recommended course through the user terminal 300 connected to the laundry processing apparatus 100 via a network. In the present embodiment, the recommended course may be outputted as a voice through the speaker in the laundry processing apparatus 100 itself and the speaker of the user terminal 300. In addition, in the present embodiment, a recommended course may be outputted as text through an output interface in the laundry processing apparatus 100 itself and a screen of the user terminal 300 (for example, a screen for outputting a laundry processing apparatus application). For example, a recommended course and whether to change to the recommended course may be outputted as voice and/or text, such as "A special load has been recognized. Do you want to change the course?" At this point, the recommendation unit 1914 may output content including the reason for changing to the recommended course. Content that includes a reason for changing to a recommended course may include, for example, images, text, and video for explaining that the wash effectiveness will be increased if the course is changed to the blanket course, and that a UE may occur if the course is not changed to the recommended course.

Upon receiving the selection signal for the recommended course, the operation control unit 1915 may change the laundry processing apparatus 100 to the recommended course. In the present embodiment, when the recommendation unit 1914 determines to change the course of the laundry processing apparatus 100, the recommendation unit 1914 may request a user to select whether to change to the recommended course while outputting the recommended course and/or the reason for changing to the recommended course. At this time, the operation control unit 1915 receives the selection signal from the user through the input interface of the laundry processing apparatus 100 itself, or receives the selection signal from the user through the user terminal 300 to change the laundry processing apparatus 100 to the recommended course. In addition, upon receiving a spoken utterance that includes a selection of a recommended course, the operation control unit 1915 may change the laundry processing apparatus 100 to the recommended course. Here, in the present embodiment, the spoken utterance may be received through the microphone of the laundry processing apparatus 100 itself and the spoken utterance may also be received through voice receiving means such as the AI speaker 230, the user terminal 300, and the interworking device 400.

In this embodiment, upon receiving the user's selection signal, the course of the laundry processing apparatus 100 may be changed to a recommended course. However, when the user has preset the laundry processing apparatus 100 to allow the course to be automatically changed, depending on the type of load, the laundry processing apparatus 100 may be automatically changed to a recommended course. In the present embodiment, when the UE occurrence has been predicted, the operation control unit 1915 may output a notification to the user about the UE occurrence. For example, the operation control unit 1915 may output an alarm indicating UE occurrence through one or more among the speaker, the UI, the user terminal 300, and the output device 200 of the laundry processing apparatus 100 itself.

Figure 11:
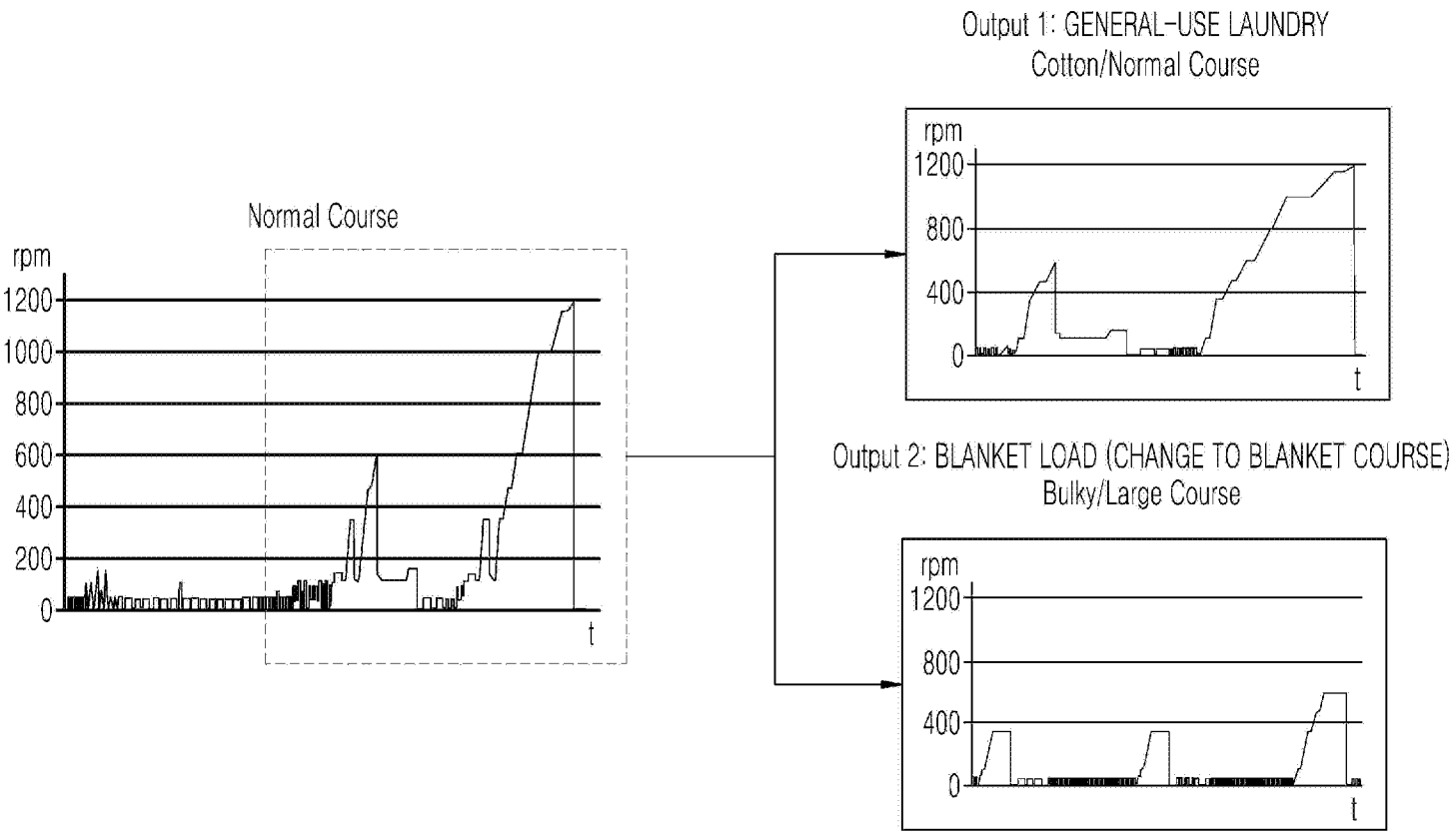
FIG. 11 is an exemplary diagram illustrating a recommended course change result of a laundry processing apparatus according to an embodiment of the present disclosure.

FIG. 11 is an exemplary diagram illustrating a recommended course change result of a laundry processing apparatus according to an embodiment of the present disclosure. In this embodiment, when the analyzed type of load is a special load, a user notification may inform the user of the situation of the load of the laundry in the laundry processing apparatus 100, and allow the user to select whether to change to the recommended course corresponding to the special load. Referring to FIG. 11, when the user selects to change the course to a blanket course (a bulky or large course) in response to a special load, a change in operation characteristics may be known during the dehydration cycle. That is, depending on the result of analyzing the type of load of the laundry, in the case of a normal load (general-use laundry), the course of the laundry processing apparatus 100 may be maintained as a normal course, and in the case of a special load (a blanket), the course of the laundry processing apparatus 100 may be changed to the blanket course, and it may be seen that the rinsing time increases and the maximum RPM decreases during the dehydration cycle.

The collection unit 1916 may collect parameters for pre-trained deep neural network learning. At this time, the parameters for the deep neural network learning may include the drive current of the motor and the rotational speed of the drum. However, in the present embodiment, the parameters for deep neural network learning are not limited thereto, and all parameters capable of classifying a load as a special load may be included. For example, the parameters may include an amount of wash water and a density of laundry. Here, the collection unit 1916 may collect data used by an actual user to refine the learning model. The collection unit 1916 may collect data during the entire cycle of the laundry processing apparatus 100, and, for example, the collection unit 1916 may collect data from a constant speed interval (for example, 50 RPM or less) in the wash cycle interval, and the collection unit 1916 may collect data from a constant speed interval of, for example, 80 RPM or less in the dehydration cycle interval. The reason for collecting data in the constant speed interval of 80 RPM or less in the dehydration cycle interval is that when the drum rotates above 80 RPM, the laundry becomes stuck to the drum, and accurate data collection becomes impossible.

When the user selects a course (a bulky or large course) corresponding to a special load and starts the wash, the collection unit 1916 may store data such as the drive current of the motor and the rotational speed of the drum in a server and/or a memory by classifying the load as a special load regardless of the results of the learning model. When the user selects a course other than the course corresponding to a special load and starts the wash, data regarding a case when the user changes the course to a course corresponding to a special load in accordance with an outputted recommended course may be stored in the server and/or the memory. Meanwhile, when the load is analyzed as a normal load depending on the result of the learning model, the user may be asked about what load he or she has put in, and data may be stored by labeling the normal load or the special load.

The learning unit 1917 may configure big data by storing data generated while the user uses the laundry processing apparatus 100 in a server, and deep learning may be executed at the server side to update related parameters in the laundry processing apparatus 100 so as to be gradually refined. That is, in the present embodiment, when the laundry processing apparatus 100 is initially released, deep learning parameters of laboratory conditions may be embedded therein, and the parameters may be updated through data accumulated as the user uses the laundry processing apparatus 100. Accordingly, the learning unit 1917 may label the data collected by the collection unit 1916 as normal loads and special loads to obtain results through supervised learning, and may store this in a memory of the laundry processing apparatus 100 itself so as to complete an evolving algorithm. In other words, the learning unit 1917 may generate a learning data set by collecting the drive current of the motor and rotational speed values of the drum during the cycle of the laundry processing apparatus 100, and may determine a learned model by training a learning data set through a machine learning algorithm in order to classify the type of load of laundry in the laundry processing apparatus 100. The learning unit 1917 may collect data used by an actual user, and allow the server to re-learn the data to generate a re-learned model. Therefore, in the present embodiment, even after data is determined as a learned model, data may be continuously collected and re-learned by applying a machine learning model, and the performance may be improved by the re-learned model.

The provision unit 1918 may provide health and beauty information, music, news, and the like to the UI 120. In addition, the provision unit 1918 may provide messenger notifications or predetermined information to play music that the user likes, and may provide today's weather in correspondence to a spoken utterance of the user, for example, a spoken utterance such as "How is the weather today?".

Figure 12:
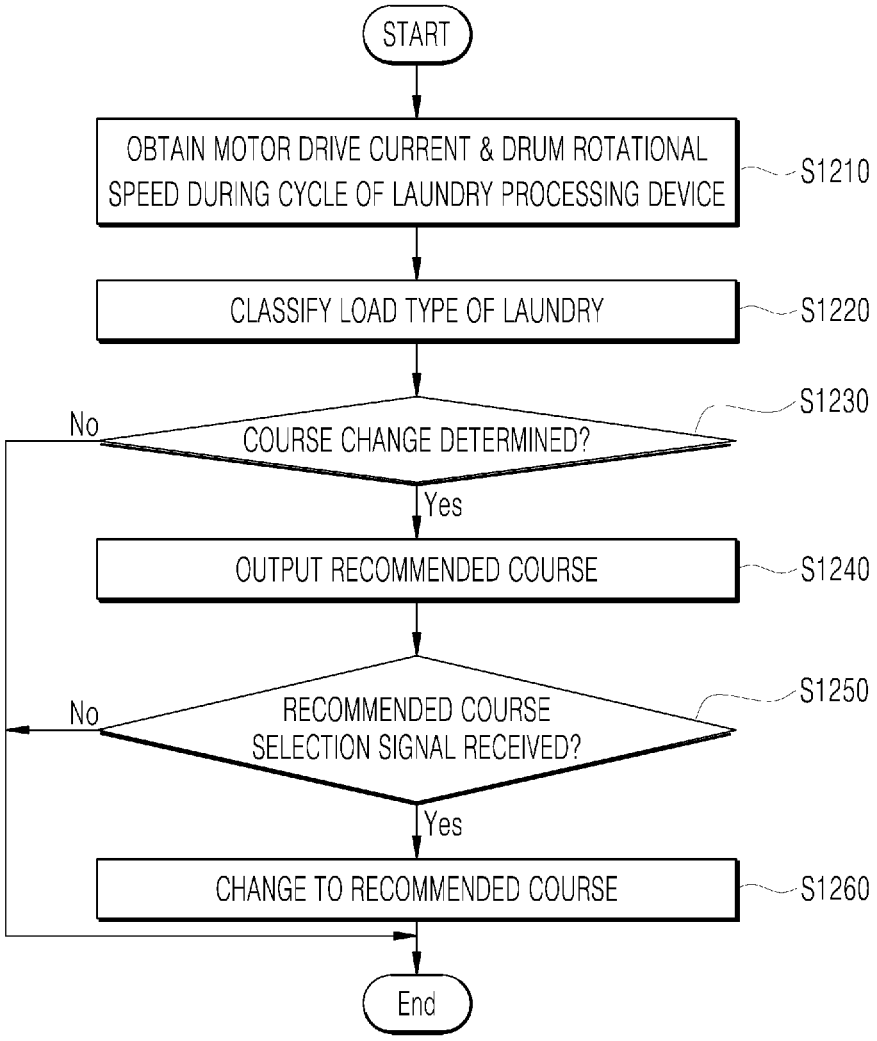
FIG. 12 is a flowchart illustrating a driving method of a laundry processing apparatus according to an embodiment of the present disclosure.

FIG. 12 is a flowchart illustrating a driving method of a laundry processing apparatus according to an embodiment of the present disclosure. In the following description, description of parts overlapping with those of FIGS. 1 to 11 will be omitted.

Referring to FIG. 12, in step S1210, the laundry processing apparatus 100 obtains the drive current of the motor and the rotational speed of the drum during the cycle of the laundry processing apparatus 100. That is, the laundry processing apparatus 100 may obtain the drive current of the motor from the motor drive current sensor 151 of the sensing unit 150, and obtain the rotational speed of the drum from the drum rotational speed sensor 152. Then, the laundry processing apparatus 100 may obtain the drive current of the motor and the rotational speed of the drum in the first motion interval, which is a cycle before water is supplied, and the second motion interval, which is a cycle after water is supplied. For example, the first motion interval may be a laundry amount detection interval and the second motion interval may be a wash cycle interval. In other words, before entering the wash cycle, the laundry processing apparatus 100 first obtains data for detecting a laundry amount and classifying load types for laundry in a state in which water has not been supplied, and enters the wash cycle and supplies water, and then obtains data for classifying load types of the laundry.

In addition, when a set time elapses after the measured RPM of the rotational speed (RPM) of the drum reaches a preset RPM, the laundry processing apparatus 100 may perform data extraction to obtain the drive current of the motor and the rotational speed of the drum. Here, in this embodiment, the set RPM may be set to a value within a predetermined range of the reference RPM which is the rotational speed of the drum set as the target. For example, the set RPM may be set to a rising threshold of the current measured RPM, and thus the rising threshold may be a value within a predetermined range of the reference RPM. That is, in this embodiment, after the rotational speed (RPM) of the drum is increased, that is, accelerated, such that the current measured RPM reaches the set RPM, a set time duration may be set as a stabilization interval for stable data extraction. In this embodiment, after passing through the stabilization interval, by setting a time period as a data extraction interval, it is possible to acquire data (the rotational speed of the drum and the drive current of the motor).

In step S1220, the laundry processing apparatus 100 classifies the type of load of the laundry located in the laundry processing apparatus 100. The laundry processing apparatus 100 may analyze a change trend of the drive current of the motor and the rotational speed of the drum, and classify the type of load of the laundry based on the change trend. That is, when the laundry processing apparatus 100 performs data extraction, when the measured values of the drive current of the motor and the rotational speed of the drum have a regular period, the load may be classified as a first load in which the laundry does not flow, and when the measured values of the drive current of the motor and the rotational speed of the drum do not have a regular period, the load may be classified as a second load in which the laundry does flow. For example, the first load may be classified as a special load in which the laundry cannot flow, and the second load may be classified as a normal load in which laundry can flow. However, during the cycle of the laundry processing apparatus 100, various situations may occur, such as when the laundry is a normal load in which the laundry can flow, but cannot flow due to the laundry being stuck in the door, or when the laundry cannot flow but the drum is not completely filled with laundry and there is some space remaining. Accordingly, in the present embodiment, a pre-trained deep neural network may be used to more accurately analyze driving characteristics that appear according to the type of load of laundry. That is, the laundry processing apparatus 100 may classify the type of load from the driving current of the motor and the rotational speed of the drum during the operation of the laundry processing apparatus 100 by using a deep neural network that is pre-trained to classify the type of load from the driving current of the motor and the rotational speed of the drum during the cycle of the laundry processing apparatus 100. That is, in this embodiment, the type of load of laundry may be obtained from experimental results of the actual value and the predicted value of the drive current of the motor and the rotational speed of the drum by using deep learning during the cycle of the laundry processing apparatus 100.

In step S1230, the laundry processing apparatus 100 determines whether to change the course of the laundry processing apparatus 100 according to the type of load. In other words, when the load type is a special load, the laundry processing apparatus 100 may determine whether to change the course of the laundry processing apparatus 100. When the type of load is a special load and a UE occurrence is predicted, the laundry processing apparatus 100 may determine whether to change the course. For example, when the laundry is a blanket and a user selects a normal course, if the analysis result is a special load, it may be determined whether to change the course of the laundry processing apparatus 100.

In step S1240, when the laundry processing apparatus 100 has determined to change the course, the laundry processing apparatus 100 outputs a recommended course corresponding to the type of load (YES in S1230). The laundry processing apparatus 100 may output, for example, a recommended course through a speaker or an output interface provided in the laundry processing apparatus 100. In addition, the laundry processing apparatus 100 may output a recommended course through the output device 200. In particular, the recommendation unit 1914 may output a recommended course through the AI speaker 230. Also, referring to FIG. 10, the laundry processing apparatus 100 may output a recommended course through the user terminal 300 connected to the laundry processing apparatus 100 via a network. In the present embodiment, the recommended course may be outputted as a voice through the speaker in the laundry processing apparatus 100 itself and the speaker of the user terminal 300. In addition, in the present embodiment, a recommended course may be outputted as text through an output interface in the laundry processing apparatus 100 itself and a screen of the user terminal 300 (for example, a screen for outputting a laundry processing apparatus application). For example, a recommended course and whether to change to the recommended course may be outputted as voice and/or text such as "A special load has been recognized. Do you want to change the course?"

In step S1250, the laundry processing apparatus 100 checks whether a selection signal is received for the outputted recommended course. At this time, the laundry processing apparatus 100 receives the selection signal from the user through the input interface of the laundry processing apparatus 100 itself, or receives the selection signal from the user through the user terminal 300. Also, the laundry processing apparatus 100 may receive a spoken utterance including a selection for a recommended course, and may receive the spoken utterance through a microphone of the laundry processing apparatus 100 itself and through a voice receiving means such as the AI speaker 230, the user terminal 300, and the interworking device 400.

In step S1260, when the selection signal for the recommended course has been received, the laundry processing apparatus 100 changes the course to the recommended course (YES in S1250). Upon receiving the user's selection signal, the course of the laundry processing apparatus 100 may be changed to a recommended course. However, when the user has preset the laundry processing apparatus 100 to allow the course to be automatically changed depending on the type of load, the laundry processing apparatus 100 may be automatically changed to the recommended course. In the present embodiment, when the UE occurrence is predicted, the laundry processing apparatus 100 may output a notification to the user about the UE occurrence.

Figure 13:
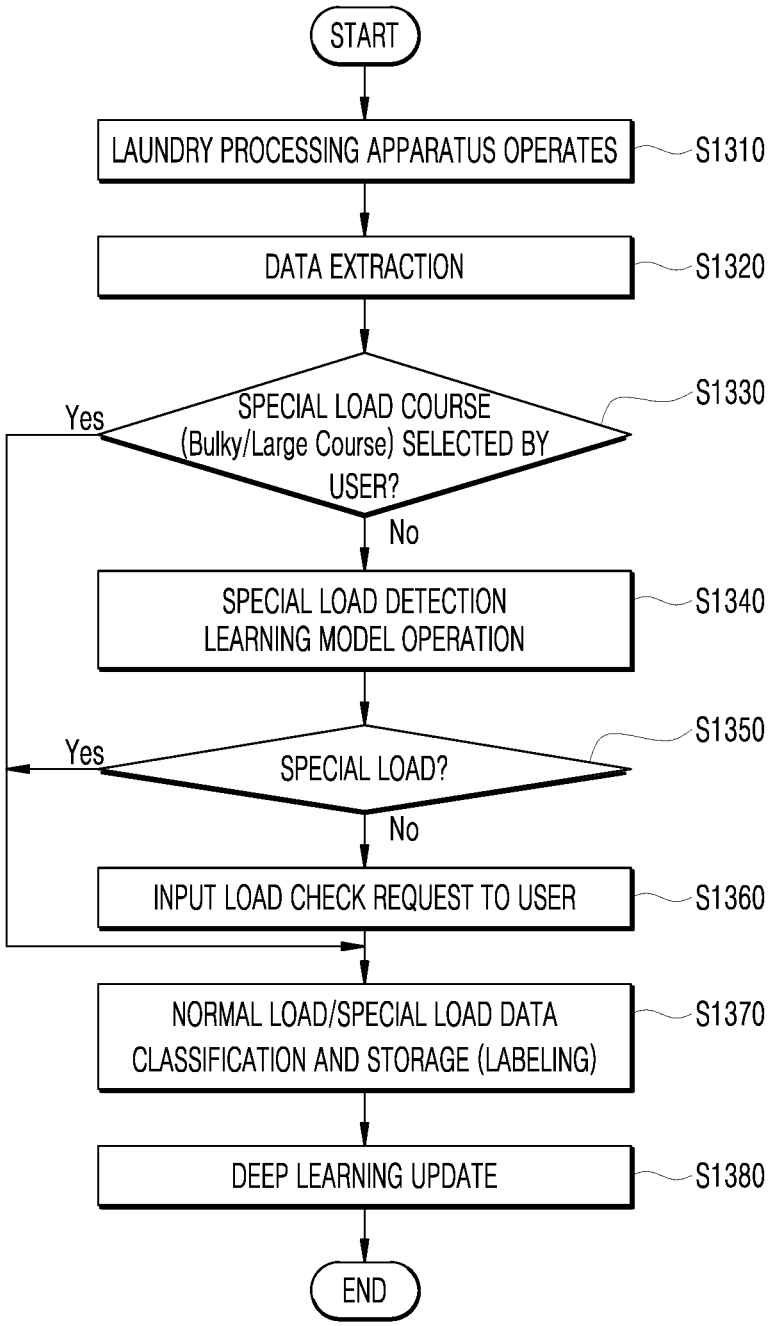
FIG. 13 is a flowchart illustrating a deep learning update method of a laundry processing apparatus according to an embodiment of the present disclosure.

FIG. 13 is a flowchart illustrating a deep learning update method of a laundry processing apparatus according to an embodiment of the present disclosure. In the following description, description of parts overlapping with those of FIGS. 1 to 12 will be omitted.

Referring to FIG. 13, in step S1310, when the power and the course of the laundry processing apparatus 100 are inputted by the user, the laundry processing apparatus 100 operates.

Then, in step S1320, the laundry processing apparatus 100 may collect parameters for updating a pre-trained deep neural network. At this time, the laundry processing apparatus 100 may collect data used by an actual user in order to refine the learning model. The laundry processing apparatus 100 may collect data during the entire cycle of the laundry processing apparatus 100, and, for example, the laundry processing apparatus 100 may collect data from a constant speed interval (for example, 50 RPM or less) in the wash cycle interval, and the laundry processing apparatus 100 may collect data from a constant speed interval of, for example, 80 RPM or less in the dehydration cycle interval.

In step S1330, the laundry processing apparatus 100 checks whether the user has selected a course corresponding to a special load. For example, the laundry processing apparatus 100 may check whether a bulky or large course has been selected when the user wants to wash the blanket.

In step S1340, the laundry processing apparatus 100 performs a special load detection learning model operation (NO in step S1330).

Then, in step S1350, the laundry processing apparatus 100 checks whether the load has been outputted as a special load according to the result of the detection learning model operation.

In step S1360, when the load has been outputted as a normal load according to the result of the detection learning model operation, the laundry control device 100 checks a request to the user about what load he or she has put in (NO in S1350).

In step S1370, when the user selects a course (a bulky or large course) corresponding to a special load and starts the wash (YES in S1330), the laundry control device 100 may store data such as the drive current of the motor and the rotational speed of the drum in a server and/or a memory by classifying the load as a special load regardless of the results of the learning model. In addition, when the user selects a course other than the course corresponding to the special load and starts the wash, when the load is outputted as a special load according to the special load detection learning model operation result (YES in S1350), the laundry processing apparatus 100 may classify the load as a special load and store data such as a drive current of a motor and a rotational speed of a drum in a server and/or a memory. In other words, when the user changes a course to a course corresponding to a special load in accordance with an outputted recommended course, the laundry processing apparatus 100 may store data from that time in a server and/or a memory. Thus, when the load is analyzed as a normal load according to the result of the learning model, the laundry processing apparatus 100 may request the user what load he or she has put in, and data may be stored by labeling the normal load or the special load.

In step S1380, the laundry processing apparatus 100 may configure big data by storing data generated while the user uses the laundry processing apparatus 100 on a server, and deep learning may be executed at the server side to update related parameters in the laundry processing apparatus 100 so as to be gradually refined. That is, in the present embodiment, when the laundry processing apparatus 100 is initially released, deep learning parameters of laboratory conditions may be embedded therein, and the parameters may be updated through data accumulated as the user uses the laundry processing apparatus 100. Accordingly, the laundry processing apparatus 100 may label the collected data as normal loads and special loads to obtain results through supervised learning, and may store this in a memory of the laundry processing apparatus 100 itself so as to complete an evolving algorithm.

The example embodiments described above may be implemented through computer programs executable through various components on a computer, and such computer programs may be recorded in computer-readable media. Examples of the computer-readable media include, but are not limited to: magnetic media such as hard disks, floppy disks, and magnetic tape: optical media such as CD-ROM disks and DVD-ROM disks; magneto-optical media such as floptical disks; and hardware devices that are specially configured to store and execute program codes, such as ROM, RAM, and flash memory devices.

The computer programs may be those specially designed and constructed for the purposes of the present disclosure or they may be of the kind well known and available to those skilled in the computer software arts. Examples of the computer program may include not only machine language codes generated by compilers but also high-level language codes that may be executed by computers using interpreters.

As used in the present application (especially in the appended claims), the terms 'a/an' and 'the' include both singular and plural references, unless the context clearly states otherwise. Also, it should be understood that any numerical range recited herein is intended to include all sub-ranges subsumed therein (unless expressly indicated otherwise) and therefore, the disclosed numeral ranges include every individual value between the minimum and maximum values of the numeral ranges.

Operations constituting the method of the present disclosure may be performed in appropriate order unless explicitly described in terms of order or described to the contrary. The present disclosure is not necessarily limited to the order of operations given in the description. All examples described herein or the terms indicative thereof ("for example", "such as") used herein are merely to describe the present disclosure in greater detail. Therefore, it should be understood that the scope of the present disclosure is not limited to the example embodiments described above or by the use of such terms unless limited by the appended claims. Furthermore, those skilled in the art will readily appreciate that many alternation, combination and modifications, may be made according to design conditions and factors within the scope of the appended claims and their equivalents.

The present disclosure is thus not limited to the example embodiments described above, and rather intended to include the following appended claims, and all modifications, equivalents, and alternatives falling within the spirit and scope of the following claims.

What is claimed is:

1. A method for driving a laundry processing apparatus, the method comprising:

obtaining, by a controller, a drive current of a motor of the laundry processing apparatus and a rotational speed of a drum of the laundry processing apparatus during at least one cycle of the laundry processing apparatus;

classifying a type of load of laundry located inside the laundry processing apparatus based on the obtained drive current of the motor and the obtained rotational speed of the drum;

determining whether to change a course of the laundry processing apparatus according to the classified type of load;

outputting a recommended course corresponding to the classified type of load when a course change of the laundry processing apparatus is determined; and changing the at least one cycle of the laundry processing apparatus to the recommended course upon receiving a selection signal for the recommended course in response to the outputting of the recommended course, wherein the obtaining of the drive current of the motor and the rotational speed of the drum comprises extracting data to obtain the obtained drive current of the motor and the obtained rotational speed of the drum when a set time elapses after a measured RPM of the rotational speed of the drum reaches a preset RPM, and wherein the classifying of the type of load of the laundry comprises, in the extracting of the data, classifying the load as a first load in which the laundry does not flow in the drum when measured values of the obtained drive current of the motor and the obtained rotational speed of the drum have a regular period, and classifying the load as a second load in which the laundry does flow in the drum when measured values of the obtained drive current of the motor and the obtained rotational speed of the drum do not have a regular period.

2. The method of claim 1, wherein the classifying of the type of load of the laundry comprises:

analyzing a change trend of the obtained drive current of the motor and the obtained rotational speed of the drum; and classifying the type of load of the laundry based on the change trend.

3. The method of claim 1, wherein the obtaining of the drive current of the motor and the rotational speed of the drum comprises obtaining the obtained drive current of the motor and the obtained rotational speed of the drum in a first motion interval, which is a cycle of the at least one cycle before water is supplied, and in a second motion interval, which is a cycle of the at least one cycle after water is supplied.

4. The method of claim 1, wherein the classifying of the type of load of the laundry comprises classifying the type of load from the obtained drive current of the motor and the obtained rotational speed of the drum obtained during the at least one cycle of the laundry processing apparatus by using a machine learning algorithm that is pre-trained to classify the type of load from previously obtained drive currents of the motor and previously obtained rotational speeds of the drum during an operation of the laundry processing apparatus.

5. The method of claim 1, wherein the determining of whether to change the course comprises:

predicting whether an unbalance error (UE) has occurred by detecting an amount of change in the obtained drive current of the motor and the obtained rotational speed of the drum; and determining whether to change a course of the laundry processing apparatus when the UE occurrence is predicted.

6. The method of claim 1, wherein the outputting of the recommended course comprises outputting the recommended course through a speaker provided in the laundry processing apparatus.

7. The method of claim 1, wherein the outputting of the recommended course comprises:

outputting the recommended course through a user terminal connected to the laundry processing apparatus via a network; and outputting content including a reason for changing to the recommended course to the user terminal.

8. The method of claim 1, wherein the changing to the recommended course comprises changing the at least one cycle of the laundry processing apparatus to the recommended course upon receiving a spoken utterance including a selection of the recommended course.

* * * * *